US009202678B2

(12) United States Patent
Dantus et al.

(10) Patent No.: US 9,202,678 B2
(45) Date of Patent: Dec. 1, 2015

(54) ULTRAFAST LASER SYSTEM FOR BIOLOGICAL MASS SPECTROMETRY

(75) Inventors: Marcos Dantus, Okemos, MI (US); Gavin Reid, Mason, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 705 days.

(21) Appl. No.: 12/618,423

(22) Filed: Nov. 13, 2009

(65) Prior Publication Data

US 2010/0123075 A1 May 20, 2010

Related U.S. Application Data

(60) Provisional application No. 61/114,809, filed on Nov. 14, 2008.

(51) Int. Cl.
*H01J 49/00* (2006.01)
*H01J 49/16* (2006.01)
*H01J 49/42* (2006.01)

(52) U.S. Cl.
CPC ..... *H01J 49/0059* (2013.01); *H01J 49/162* (2013.01); *H01J 49/4205* (2013.01)

(58) Field of Classification Search
None
See application file for complete search history.

(56) References Cited

U.S. PATENT DOCUMENTS 4,455,089 A * 6/1984 Yeung ..... G01N 21/45 356/246
5,526,155 A 6/1996 Knox et al.
6,111,251 A 8/2000 Hillenkamp
6,130,426 A 10/2000 Laukien et al.
6,888,134 B2 * 5/2005 Hashimoto ..... H01J 49/0481 250/281
6,994,960 B1 2/2006 Foote et al.
7,105,811 B2 9/2006 Dantus et al.
7,342,223 B2 3/2008 Ohkubo et al.
7,355,169 B2 4/2008 McLuckey et al.
7,439,497 B2 10/2008 Dantus et al.
7,450,618 B2 11/2008 Dantus et al.
7,557,343 B2 7/2009 Hansen et al.
7,560,689 B2 7/2009 Ban et al.
7,567,596 B2 7/2009 Dantus et al.
7,583,710 B2 9/2009 Dantus et al.
7,609,731 B2 * 10/2009 Dantus ..... G01N 21/4795 372/22
2003/0099264 A1 5/2003 Dantus et al.

(Continued)

FOREIGN PATENT DOCUMENTS

BE WO 2004111636 A2 * 12/2004 ..... C07K 14/47
BE WO 2004111636 A3 * 3/2005 ..... C07K 14/47

(Continued)

OTHER PUBLICATIONS

A. Powe et al.; "Molecular Fluorescence, Phosphorescence, and Chemiluminescence Spectrometry"; Anal. Chem., vol. 76, No. 15; Aug. 15, 2004; pp. 4614-4634.

(Continued)

*Primary Examiner* — Andrew Smyth
(74) *Attorney, Agent, or Firm* — Harness, Dickey & Pierce, P.L.C.

(57) ABSTRACT

One aspect of the system provides the use of a laser with a mass spectrometer. Another aspect of the present application employs a laser emitting a pulse of less than one picosecond duration into an ion-trap mass spectrometer. In yet another aspect of the present application, a femtosecond laser beam pulse is emitted upon an ionized specimen to remove at least one electron therefrom.

69 Claims, 14 Drawing Sheets

(56) References Cited

U.S. PATENT DOCUMENTS

| | | | | |
|---|---|---|---|---|
| 2004/0089804 | A1* | 5/2004 | Dantus | H01J 49/194 250/288 |
| 2004/0128081 | A1* | 7/2004 | Rabitz | G01N 21/636 702/23 |
| 2004/0233944 | A1 | 11/2004 | Dantus et al. | |
| 2005/0021243 | A1 | 1/2005 | Dantus et al. | |
| 2005/0035285 | A1 | 2/2005 | Tan et al. | |
| 2005/0221500 | A1 | 10/2005 | Reid et al. | |
| 2005/0232317 | A1 | 10/2005 | Dantus et al. | |
| 2006/0066848 | A1* | 3/2006 | Frankel | G01J 3/44 356/301 |
| 2006/0079002 | A1* | 4/2006 | Gologan | B82Y 30/00 436/174 |
| 2006/0094121 | A1 | 5/2006 | Reid et al. | |
| 2006/0187974 | A1 | 8/2006 | Dantus | |
| 2007/0042431 | A1* | 2/2007 | Urdea | G01N 33/6803 435/7.1 |
| 2007/0064748 | A1 | 3/2007 | Mirov et al. | |
| 2007/0069124 | A1* | 3/2007 | Baba | H01J 49/0054 250/288 |
| 2007/0085040 | A1* | 4/2007 | Reilly | H01J 49/0059 250/504 R |
| 2008/0011078 | A1* | 1/2008 | Ehrhard | F26B 5/06 73/335.01 |
| 2008/0093547 | A1* | 4/2008 | Hartmer | H01J 49/0045 250/283 |
| 2008/0142705 | A1* | 6/2008 | Schwartz | H01J 49/0045 250/292 |
| 2008/0170218 | A1 | 7/2008 | Dantus et al. | |
| 2009/0039245 | A1* | 2/2009 | Brown | G02B 27/0927 250/282 |
| 2009/0053817 | A1 | 2/2009 | Reid et al. | |
| 2009/0122819 | A1 | 5/2009 | Dantus et al. | |
| 2009/0188901 | A1 | 7/2009 | Dantus | |
| 2009/0207869 | A1 | 8/2009 | Dantus et al. | |
| 2009/0212769 | A1 | 8/2009 | Stoica et al. | |
| 2009/0238222 | A1 | 9/2009 | Dantus et al. | |
| 2009/0242753 | A1 | 10/2009 | Dogourd et al. | |
| 2009/0256071 | A1 | 10/2009 | Dantus et al. | |
| 2009/0257464 | A1 | 10/2009 | Dantus et al. | |
| 2009/0296744 | A1 | 12/2009 | Dantus et al. | |
| 2010/0187208 | A1 | 7/2010 | Dantus et al. | |

FOREIGN PATENT DOCUMENTS

| | | | | |
|---|---|---|---|---|
| WO | WO-9957318 | A2 | 11/1999 | |
| WO | WO-0070647 | A1 | 11/2000 | |
| WO | WO-02061799 | A2 | 8/2002 | |
| WO | WO-03017319 | A2 | 2/2003 | |
| WO | WO-03098190 | A2 | 11/2003 | |
| WO | WO-2004046731 | A2 | 6/2004 | |
| WO | WO 2004111636 | A2 * | 12/2004 | G01N 30/88 |
| WO | WO-2005088783 | A1 | 9/2005 | |
| WO | WO-2005110955 | A1 | 11/2005 | |
| WO | WO-2006023398 | A2 | 3/2006 | |
| WO | WO-2006088841 | A1 | 8/2006 | |
| WO | WO-2007001308 | A2 | 1/2007 | |
| WO | WO-2007008615 | A2 | 1/2007 | |
| WO | WO-2007028119 | A2 | 3/2007 | |
| WO | WO-2008063602 | A2 | 5/2008 | |
| WO | WO-2009086122 | A2 | 7/2009 | |

OTHER PUBLICATIONS

Abraham, Jacinth, et al., "Phosphorylation of p53 protein in response to ionizing radiation occurs at multiple sites in both normal and DNA-PK deficient cells," Oncogene vol. 18 (1999) pp. 1521-1527.

Allison W. Albrecht et al.; "Experimental distinction between phase shifts and time delays: Implications for femtosecond spectroscopy and coherent control of chemical reactions"; Journal of Chemical Physics, vol. 111, No. 24; Dec. 22, 1999; pp. 10934-10955.

Anensen, N., et al., "Proteomics of p53 in Diagnostics and Therapy of Acute Myeloid Leukemia," Current Pharmaceutical Biotechnology 2006; 7(3) 9 pages.

Antoine, Rodolphe, et al., "Photo-induced formation of radical anion peptides, Electron photo-detachment dissociation experiments," RCM Letter to the Editor, Rapid Communications in Mass Spectrometry, vol. 21 (2007) pp. 265-268.

Assion, A. et al; "Control of Chemical Reactions by Feedback-Optimized Phase-Shaped Femtosecond Laser Pulses"; Science Magazine, vol. 282; Oct. 30, 1998; pp. 919-922.

B. Xu, Y. Coello, V.Lozovoy, D. Harris; M. Dantus, Pulse Shaping of Octave Spanning Femtosecond Laser Pulses, Optics Express, vol. 14, No. 22, Oct. 30, 2006, six pages.

B.D. Fainberg; "Diagram Technique for Nonlinear Optical Spectroscopy in the Fast Electronic Dephasing Limit"; Journal of the Chinese Chemical Society, 47; 2000; pp. 579-582.

B.J. Pearson et al.; "Control of Raman Lasing in the Nonimpulsive Regime"; Physical Review Letters, vol. 92, No. 24; Jun. 18, 2004; pp. 243003-1-243003-4.

Butcher, Steve, et al., "Multiphoton approach shapes ultrafast pulses," Pulse Shaping, (2006) Institute of Physics and IOP Publishing Ltd., 3 pages.

Christophe Dorrer et al.; "Spectral resolution and sampling issues in Fourier-transform spectral interferometry"; J. Opt. Soc. Am. B, vol. 17, No. 10; Oct. 2000; pp. 1795-1802.

Chu, Ivan K., et al., "Generation of Peptide Radical Dications via Low-Energy Collision-Induced Dissociation of $[Cu^{II}(terpy)(M+H)]^{\bullet 3+}$," J Am Soc Mass Spectrom 2005; 16, 1795-1804.

Comstock et al.; "Multiphoton intrapulse interference 6; binary phase shaping"; Optics Express Opt. Soc . . . America USA, vol. 12, No. 6, Mar. 22, 2004; pp. 1061-1066.

D. Oron et al..; "All-optical processing in coherent nonlinear spectroscopy"; Physical Review A 70; 2004; pp. 023415-1-023415-4.

D. Oron et al..; "Femtosecond Phase-and-Polaration Control for Background-Free Coherent Anti-Stokes Raman Spectroscopy"; Physical Review Letters, vol. 90, No. 91; May 30, 2003; pp. 213902-1-213902-4.

David M. Jonas et al.; "Femtosecond Wavepacket Spectroscopy: Influence of Temperature, Wavelength and Pulse Duration"; J. Phys. Chem.; 1995; pp. 2594-2608.

de Hoffmann, Edmond, et al., "Mass Spectrometry Principles and Applications," Third Edition (2007) pp. 85-173.

Dela Cruz, J. et al., "Use of coherent control methods through scattering biological tissue to achieve functional imaging," PNAS, vol. 101, No. 49, Dec. 7, 2004, pp. 16996-17001.

Dela Cruz, J. M. et al.; "Coherent Control Improves Biomedical Imaging With Ultrashort Shaped Pulses;" Journal of Photochemistry and Photobiology A: Chemistry 180, Mar. 2006; pp. 307-313.

Dela Cruz, J.M. et al.; "Multiphoton Intrapulse Interference 3: Probing Microscopic Chemical Environments"; J. Phys. Chem. A 2004, 108; pp. 53-58.

Dela Cruz, Johanna M., et al., "Isomeric identification by laser control mass spectrometry," Journal of Mass Spectrometry (2007) 42; 178-186.

Dela Cruz, Johanna M., et al., "Quantitative mass spectrometric identification of isomers applying coherent laser control," Journal of Physical Chemistry A ACS USA, vol. 109, No. 38 (Sep. 29, 2005) pp. 8447-8450, XP002431289, ISSN: 1089-5639, figure 1.

Dunbar, Robert C., "Photodissociation of trapped ions," International Journal of Mass Spectrometry 200 (2000) pp. 571-589.

Dunn, Jamie, D., et al., "Phosphopeptide Enrichment Using MALDI Plates Modified with High-Capacity Polymer Brushes," Analytical Chemistry, vol. 80, No. 15, Aug. 1, 2008.

E. Tokunaga et al.; "Frequency-domain interferometer for femtosecond time-resolved phase spectroscopy"; Optics Letters, vol. 17, No. 16; Aug. 15, 1992, pp. 1131-1133.

Eng, Jimmy K., et al., "An Approach to Correlate Tandem Mass Spectral Data of Peptide iw Amino Acid Sequences in a Protein Database," American Society for Mass Spectrometry (Jun. 1994) pp. 976-989.

Finnigan™ LCQ™ Series, "Getting Started," 97344-97022 Revision B, Thermo Electron Corporation, 2003 (154 pages).

Finnigan™ LCQ™ Series, "Hardware Manual," 97344-97023 Revision B, Thermo Electron Corporation, 2003 (382 pages).

(56) References Cited

OTHER PUBLICATIONS

Finnigan™ LTQ™, "Getting Started," 97055-97012 Revision B, Thermo Electron Corporation, 2003 (160 pages).
Finnigan™ LTQ™, "Hardware Manual," 97055-97013 Revision B, Thermo Electron Corporation, 2003 (206 pages).
Finnigan™ vMALDI™ Source "Getting Started," 97055-97014 Revision A, Thermo Electron Corporation, Aug. 2004 (121 pages).
Finnigan™ vMALDI™ Source, "Hardware Manual," 97155-97001 Revision A, Thermo Electron Corporation, 2003 (121 pages).
Finnigan™ Xcalibur™ "Getting Productive: Qualitative Analysis," XCALI-97101 Revision A, Feb. 2005 (282 pages).
Froelich, Jennifer M., et al., "The origin and control of ex vivo oxidative peptide modifications prior to mass spectrometry analysis," Proteomics, vol. 8 (2008) pp. 1334-1345.
Fung, Eva Y.M., et al., "Facile Disulfide Bond Cleavage in Gaseous Peptide and Protein Cations by Ultraviolet Photodissociatino at 157 nm," Angew. Cehm. Int. Ed. (2005) 44, pp. 5399-6403.
G. Roberts; "Abstract-Interference effects in femtosecond spectroscopy"; Philosophical Transactions of the Royal Society of London Series A—Mathematical Physical and Engineering Sciences; 360 (1794): 987-1021; May 15, 2002 (1 page).
Gabryelski, Wojciech, et al., Photo-induced dissociation of electrospray generated ions in an ion trap/time-of-flight mass spectrometer, Review of Scientific Instruments, vol. 70, No. 11 (1999) American Institute of Physics, pp. 4192-4199.
Guyon, Laurent, et al., "Femtosecond pump-probe experiments on trapped flavin: Optical control dissociation," The Journal of Chemical Physics vol. 128 (2008) pp. 075103-1 through 075103-5.
Harrison, Alex G., et al., "Scrambling of Sequence Information in Collision-Induced Dissociation of Peptides," J. Am. Chem. Soc. 2006; 128 pp. 10364-10365.
Hu, Yongjun, et al., "Does IVR Take Place Prior to Peptide Ion Dissociation?" J. Phys. Chem. A, vol. 107, No. 34 (Aug. 28, 2003) pp. 6507-6514.
Hunt, Donald F., et al., "Protein sequencing by tandem mass spectrometry," Proc. Natl. Acad. Sci. USA, 1986;83(17):6233-7.
J.G. Underwood et al.,; "Switched Wave Packets: A Route to Nonperturbative Quantum Control"; Physical Review Letters, vol. 90, No. 22; Jun. 6, 2003; pp. 223001-1-223001-4.
John D. Hybl et al; "Two-dimensional Fourier transform electronic spectroscopy"; Journal of Chemical Physics, vol. 115, No. 14; Oct. 8, 2001; pp. 6606-6622.
Kolenda, Jürgen, et al., "Pulse Shaping with the MIIPS-Process," Laser Technology, (Jan. 2008) Photonik International, p. 68.
Kroner, D. et al., Asymmetric Laser Excitation in Chiral Molecules: Quantum Simulations for a Proposed Experiment, Chemical Physics Letters Elsevier Netherland, vol. 372, No. 1-2, Apr. 22, 2003, pp. 242-248.
Lepetit et al.; "Linear techniques of phase measurement by femtosecond spectral interferometry for applications in spectroscopy"; J. Opt. Soc. Am. B, vol. 12, No. 12; Dec. 1995; pp. 2467-2474.
L.D. Ziegler et al.; "Nonlinear polarization description of phase-locked pulse-pair spectroscopy"; J. Chem. Phys., vol. 97, No. 7; Oct. 1, 1992; pp. 4704-4713.
Laarmann, T., et al., "Femtosecond pulse shaping as analytic tool in mass spectrometry of complex polyatomic systems," J Phys B-at Mol Opt 2008;41(7).
Larraillet, Vincent et al, "Activated-Electron Photodetachment Dissociation for the Structural Characterization of Protein Polyanions," Analytical Chemistry, vol. 81, No. 20 (Oct. 15, 2009) pp. 8410-8416.
Laskin, Julia, et al, "Charge-Remote Fragmentation of Odd-Electron Peptide Ions," Anal. Chem. (Sep. 1, 2007), vol. 79, No. 17, 6607-6614.
Lemoine, Jerome, et al., "UV photodissociation of phospho-seryl-containing peptides: laser stabilization of the phospho-seryl bond with multistage mass spectrometry," Rapid Commun. Mass Spectrom. 2006; 20: 507-511.
Lim, Sang-Hyun et al., "Chemical Imaging by Single Pulse Interferometric Coherent Anti-Stokes Raman Scattering Microscopy," (2006) pp. 5196-5204. vol. 110, No. 11. J. Phys. Chem. B.
Lim, Sang-Hyun et al.; "Single-Pulse Phase-Control Interferometric Coherent Anti-Stokes Raman Scattering Spectroscopy;" Physical Review A, 72, (Oct. 2005); pp. 041803-1-041803-4.
Lozovoy, V. V. et al.: "Multiphoton Intrapulse Interference. IV. Ultrashort Laser Pulse Spectral Phase Characterization and Compensation;" Optics Letters, vol. 29, No. 7, Apr. 1, 2004; pp. 775-777.
Lozovoy, V. V. et al.; "Spectral Phase Optimization of Femtosecond Laser Pulses for Narrow-Band, Low-Background Nonlinear Spectroscopy;" Optics Express, vol. 13, No. 26, Dec. 26, 2005; pp. 10882-10887.
Lozovoy, V. V., et al., "Laser Control of Physicochemical Processes; Experiments and Applications," The Royal Society of Chemistry 2006, Annu. Rep. Prog. Chem, Sect. C, 102. www.rsc.org/annrepc (2006) pp. 227-258.
Lozovoy, V.V.; "Multiphoton intrapulse interference. II. Control of two- and three-photon laser induced flurorescence with shaped pulses"; J. Chem. Phys. 118 (7); Feb. 15, 2005; pp. 3187-3196.
M. Renard et al.; "Controlling ground-state rotational dynamics of molecules by shaped femtosecond laser pulses"; Physical Review A 69; 2004; 043401-1-043401-6.
M. Schurenberg et al.; "Abstract-Laser desorption/ionization mass spectrometry of peptides and proteins with particle suspension matrixes"; Analytical Chemistry; 71 (1): 221-229; Jan. 1, 1999 (1 page).
M.M. Salour et al.; "Observation of Ramsey's Interference Fringes in the Profile of Doppler-Free Two-Photon Resonances"; Physical Review Letters, vol. 38, No. 14; Apr. 4, 1977; pp. 757-760.
M.O. Scully, et al.; "Fast Cars: Engineering a laser spectroscopic technique for rapid identification of bacterial spores"; PNAS; vol. 99, No. 17; Aug. 20, 2002; pp. 10994-11001.
Marcos Dantus; "Coherent Nonlinear Spectroscopy: From Femtosecond Dynamics to Control"; Annu. Rev. Phys. Chem. 2001; pp. 639-679, C1-C7.
McGraw-Hill Encyclopedia of Science & Technology, 6th Ed.; "Mass spectrometry"; 1987; pp. 492-502 (12 pages).
N. Dudovich et al.; "Quantum Control of the Angular Momentum Distribution in Multiphoton Absorption Processes"; Physical Review Letters, vol. 93, No. 10; Mar. 12, 2004; pp. 103003-1-103003-4.
N. Dudovich et al.; "Single-pulse coherent anti-Stokes Raman spectroscopy in the fingerprint spectral region"; J. of Chem. Phys., vol. 118, No. 20; May 22, 2003; pp. 9208-9215.
N.F. Scherer et al.; "Fluorescence-detected wave packet interferometry. II. Role of rotations and determination of the susceptibility"; J. Chem. Phys., vol. 96, No. 6; Mar. 15, 1992; pp. 4180-4194.
Nemes, Peter, et al., "Laser Ablation Electrospray Ionizatino for Atmospheric Pressure, in Vivo, and Imaging Mass Spectrometry," Analytical Chemistry, vol. 79, No. 21 (Nov. 1, 2007) American Chemical Society, pp. 8098-8106.
Nirit Dudovich et al.; "Single-pulse coherently controlled nonlinear Raman spectroscopy and microscopy"; Nature magazine, vol. 418; Aug. 1, 2002; pp. 512-514.
Norbert F. Scherer et al.; "Fluorescence-detected wave packet interferometry: Time resolved molecular spectroscopy with sequences of femtosecond phase-locked pulses"; J. Chem. Phys., vol. 95, No. 3; Aug. 1, 1991; pp. 1487-1511.
Ocean Optics Inc.; "HR4000 High-resolution Spectrometer" http://oceanoptics.com/products/hr4000.asp; Jun. 25, 2005 (p. 1 of 4-p. 4 of 4).
Ocean Optics Inc.; "S2000 Miniature Fiber Optic Spectrometer" http://oceanoptics.com/products/s2000.asp; Jun. 25, 2005 (p. 1 of 4-p. 4 of 4).
Ocean Optics Inc.; "USB2000 Miniature Fiber Optic Spectrometer" http://oceanoptics.com/products/usb2000.asp; Jun. 25, 2005 (p. 1 of 7-p. 6 of 7).
Ogilvie, Jennifer P., et al., "Use of coherent control for selective two-photon fluorescence microscopy in live organisms," Optical Society of America (Jan. 2006) 8 pages.
Olsen, Jesper V., et al., "Global, In Vivo, and Site-Specific Phosphorylation Dynamics in Signaling Networks," Cell 127 (Nov. 3, 2006) pp. 635-648.
Palumbo, Amanda M., et al., "Mechanistic Insights into the Multistage Gas-Phase Fragmentation Behavior of Phosphoserine- and

(56) References Cited

OTHER PUBLICATIONS

Phosphothreonine-Containing Peptides," Technical Notes, Journal of Proteome Research 2008; 7 American Chemical Society, pp. 771-779.
Pastirk, I. et al; "Selective two-photon microscopy with shaped femtosecond pulses"; Opt. Express 11; 2003; pp. 1695-1701.
Pastirk, I., et al., "Multidimensional Analytical Method Based on Binary Phase Shaping of Femtosecond Pulses," J. Phys. Chem. A, vol. 109, No. 11, Feb. 23, 2005; pp. 2413-2416.
Pastirk, I., et al., "No loss spectral phase correction and arbitrary phase shaping of regeneratively amplified femtosecond pulses using MIIPS," Optics Express, vol. 14, No. 20, (Oct. 2, 2006) pp. 9537-9543.
Pastirk, Igor, et al., "Femtosecond pulse shaping adds new dimension to mass spectrometry," Applied Optics, vol. 46, No. 19 (Jul. 1, 2007) Optical Society of America, pp. 4041-4045.
Pelfang Tian et al., Femtosecond Phase-Coherent Two-Dimensional Spectroscopy, Science American Assoc. Adv. Sci. USA, vol. 300, No. 5625, Jun. 6, 2003, pp. 1553-1555.
Perry, Michael D., et al., "Terawatt to Petawatt Subpicosecond Lasers", Articles, (May 13, 1994), vol. 264, Science.
Pfeiffer, W., et al., "Ultrafast Spatio-Temporal Near-Field Control", IEEE 2005 European Quantum Electronics Conference, 0-7803-8973-5/05, (Jun. 2005) p. 169 (1 page).
Posthumus, J.H., "The dynamics of small molecules in intense laser fields," Reports on Progress in Physics, 67 (2004) Institute of Physics Publishing, pp. 623-665.
Richard M. Williams et al.; "Compositional control of rovibrational wave packets in the E(1 Eg) "shelf" state of Li2 via quantum-state-resolved intermediate state selection"; J. Chem. Phys. vol. 106, No. 20; May 22, 1997; pp. 8310-8323.
Robert J. Levis et al.; "Selective Bond Dissociation and Rearrangement with Optimally Tailored, Strong-Field Laser Pulses"; Science Magazine, vol. 292; Apr. 27, 2001; pp. 709-713.
S. Kovtoun et al.; "Mass-Correlated Pulsed Extraction : Theoretical Analysis and Implementation With a Linear Matrix-Assisted Laser Desorption/Ionization Time of Flight Mass Spectrometer;" Journal of the American Society for Mass Spectrometry, Elsevier Science Inc., vol. 11, 2000; pp. 841-853.
S. Nath, D. Urbanek, S. Kern, M. Berg, High-Resolution Raman Spectra with Femtosecond Pulses: An Example of Combined Time- and Frequency-Domain Spectroscopy, Physical Review Letters, 2006, pp. 267401-1 to 267401-4.
Scaffidi, J., et al., "Spatial and Temporal Dependence of Interspark Interactions in Femtosecond-Nanosecond Dual Pulse Laser-Induced Breakdown Spectroscopy", Applied Optics, vol. 43, No. 27, Sep. 20, 2004, XP-002462408, pp. 5243-5250.
Shchatsinin, I., et al., "Multiphoton excitation and ionization by elliptically polarized, intense short laser pulses: Recognizing multielectron dynamics and doorway states in C60 vs Xe," Physical Review A vol. 79 (2009) pp. 053414-1 through 053414-17.
Shimizu, Satoru, et al., "Spectral phase transfer for indirect phase control of sub-20-fs deep UV pulses," Optics Express, vol. 13, No. 17 (Aug. 22, 2005) pp. 6345-6353.
T.C. Weinacht et al.; "Using feedback for coherent control of quantum systems"; Journal of Optics B: Quantum and Semiclassical Optics; 2002; pp. R35-R52.
V. Prokhorenko et al.; "Coherent control of the population transfer in complex sovated molecules at weak excitation. An experimental study"; The J. of Chem. Phys., 122; 2005; 184502-1-184502-11.
Van Berkel, Gary J., et al., "Established and emerging atmospheric pressure surface sampling/ionization techniques for mass spectrometry," Journal of Mass Spectrometry vol. 43 (Jul. 2008) pp. 1161-1180.
VandenBout, D.A. et al.; "Discrete intensity jumps and intramolecular electronic energy transfer in the spectroscopy of single conjugated polymer molecules"; Science 277; 1997; pp. 1074-1077.
Vertes, Akos, et al., "Molecular imaging by Mid-IR laser ablation mass spectrometry," Appl Phys A (2008) 93; 885-891.
von Vacano, Bernhard, et al., "Shaper-assisted collinear Spider: fast and simple broadband pulse compression in nonlinear microscopy," vol. 24, No. 5, (May 2007) J. Opt. Soc. Am. B, pp. 1091-1100.
W. Wohlleben et al.; "Coherent Control for Spectroscopy and Manipulation of Biological Dynamics"; Chem. Phys. Chem., 6; 2005; pp. 850-857.
Walowicz, K.A. et al.; "Multiphoton Intrapulse Interference 1: Control of Multiphoton Processes in Condensed Phases"; J. Phys. Chem A 106 (41); Oct. 17, 2002; pp. 9369-9373.
Wu, C. et al., Mass and Photoelectron Spectrometer for Studying Field-Induced Ionization of Molecules, International Journal of Mass Spectrometry, Elsevier Science Publishers, Amsterdam, NL, vol. 216, No. 3, May 15, 2002, pp. 249-255.
Xi, Peng, et al, "Greater signal, increased depth, and less photobleaching in two-photon microscopy with 10 fs pulses," Optics Communications 281 (2008) 1841-1849.
Xu, B et al.; "Quantitative Investigation of the Multiphoton Intrapuse Interference Phase Scan Method for Simultaneous Phase Measurement and Compensation of Femtosecond Laser Pulses;" J. Opt. Soc. Am. B, vol. 23, No. 4, Apr. 2006; pp. 750-759.
Y.J. Yan et al.; "Pulse shaping and coherent Raman spectroscopy in condensed phases"; J. Chem. Phys 94 (2); Jan. 15, 1991; pp. 997-1001.
Zipfel, W.R. et al.; "Nonlinear magic: multiphoto microscopy in the biosciences"; Natire Biotechnology, 121 (11); Nov. 2003; pp. 1369-1377.
Krampert, Gerhard; "Femtosecond Quantum Control and Adaptive Polarization Pulse Shaping", Dissertation zur Erlangung des naturwissenschaftlichen Doktorgrades der Bayerischen Julius-Maximilians-Universität Würzburg, 2004, 135 pages.
Diau, Eric W., et al.; "Femtosecond Activation of Reactions and the Concept of Nonergodic Molecules;" Science, vol. 279, No. 847, Feb. 6, 1998; cover page and pp. 847-851.
Gabryelski, Wojciech, et al.; "Photoinduced Dissociation of Electrospray-Generated Ions in an Ion Trap/Time-of-Flight Mass Spectrometer Using a Pulsed $CO_2$ Laser;" Rapid Communications in Mass Spectrometry, vol. 16, No. 19, Oct. 15, 2002; pp. 1805-1811
Payne, Anne H., et al.; "Thermally Assisted Infrared Multiphoton Photodissociation in a Quadrupole Ion Trap;" Analytical Chemistry, vol. 73, No. 15, Aug. 1, 2001; pp. 3542-3548.

* cited by examiner

ULTRAFAST LASER SYSTEM FOR BIOLOGICAL MASS SPECTROMETRY

CROSS-REFERENCE TO RELATED APPLICATIONS

This application Claims the benefit of U.S. Provisional Application No. 61/114,809, filed on Nov. 14, 2008, which is incorporated by reference herein.

STATEMENT OF GOVERNMENT RIGHTS

This invention was made with government support under CHE0547940 and CHE0647901 awarded by the National Science Foundation. The government has certain rights in the invention.

BACKGROUND AND SUMMARY

This application relates generally to mass spectrometry and more particularly to an ultrafast laser system for biological mass spectrometry.

Over the past decade, mass spectrometry ("MS") has become a key analytical tool for analyzing proteins and metabolites. MS has been used to identify post-translational modifications ("PTMs") of proteins, which are in some cases the signature of aging processes and malignant disease, making them valuable markers for medical diagnosis. Typically, complex protein mixtures or individual proteins resolved by electrophoretic or chromatographic methods have been traditionally subjected to proteolysis, and then the resultant peptide mixtures were introduced to the mass spectrometer by on-line chromatography. Peptide sequence information was then obtained via subjecting individual ions to fragmentation by collision-induced dissociation ("CID") tandem mass spectrometry ("MS/MS"). Protein identification was then achieved by database analysis using sophisticated search algorithms (e.g., SEQUEST, Mascot), to correlate the uninterpreted peptide MS/MS spectra with simulated (predicted) product ion spectra derived from peptides of the same mass contained in the available databases. However, the generally limited ability to selectively control or direct the fragmentation reactions of peptide ions during CID-MS/MS towards the formation of structurally informative 'sequence' ions (i.e., those resulting from amide peptide bond cleavages) or 'non-sequence' ions (i.e., those resulting from cleavage of amino acid side chains that are characteristic of the presence of post translational modifications), placed significant limitations on the application of mass spectrometry and associated methodologies for comprehensive proteome analysis. Recently, several groups have begun to explore the use of laser photo-induced dissociation ("PID") to access alternative or complementary fragmentation pathways to those observed by conventional collision-induced dissociation. However, these approaches typically did not have bond-selective control over the site of energy absorption from the laser pulse, due to rapid intramolecular vibrational relaxation that occurred prior to bond cleavage, and typically required the presence of a chromophore that was able to absorb energy at the wavelength of the laser to induce fragmentation.

The application of tandem mass spectrometry ("MS/MS") methods to the identification and characterization of proteolytically derived peptide ions has underpinned the emergent field of proteomics. However, the ability of these conventional approaches to generate sufficient product ions from which the sequence of an unknown peptide can be determined, or to unambiguously characterize the specific site(s)

of post-translational modifications within these peptides, was highly dependant on the specific method employed for ion activation, as well as the sequence and charge state of the precursor ion selected for analysis. In practice, collision induced dissociation, whereby energy deposition occurs through ion-molecule collisions followed by internal vibrational energy redistribution prior to dissociation, often resulted in incomplete backbone fragmentation, or the dominant loss of labile groups from side chains containing post-translational modifications such as phosphorylation, particularly for peptides observed at low charge states. Thus, there has been great interest in the development of alternate activation methods, such as surface induced dissociation ("SID"), infrared multiphoton dissociation ("IRMPD"), ultraviolet photodissociation ("UVPD"), electron capture and electron transfer dissociation ("ECD" and "ETD") and metastable atom dissociation, that yield greater sequence information, and that provide selective control over the fragmentation chemistry independently of the identity of the precursor ion. However, each of these methods suffers from certain limitations. For example, ECD and ETD are applicable only to the analysis of multiply-charged precursor ions, while IRMPD and UVPD efficiencies are dependant on the presence of a suitable chromophore for photon absorption.

In accordance with the present application, one aspect of the system provides a laser and a mass spectrometer. Another aspect of the present application employs a laser emitting a laser beam pulse duration of less than one picosecond into an ion-trap mass spectrometer. A further aspect of the present application provides entrance and exit holes in a mass spectrometer for a laser beam pulse passing therethrough, which advantageously reduces undesired surface charges otherwise possible from misalignment within the mass spectrometer. In yet another aspect of the present application, a femtosecond laser beam pulse causes the ultrafast loss of an election from the charged ions for optional further fragmentation and more detailed mass spectrometry analysis. Another aspect of the present application uses electrospray with mass spectrometry and a shaped laser beam pulse having a duration of less than one picosecond. In still another aspect of the present application, Multiphoton Intrapulse Interference Phase Scan procedures are used to characterize and compensate for undesired characteristics in a laser beam pulse used with an ion-trap mass spectrometer. An additional aspect of the present application includes software instructions which assist in determining whether desired mass spectra information has been obtained, and if not, isolating product ions and then causing another ionization and/or fragmentation process to occur. A method of using a laser system for biological mass spectrometry is also provided. Another method employs emitting a shaped laser pulse at an ionized specimen, further ionizing the ionized specimen by removing at least one electron, isolating the ionized specimen, and then using another supplemental activation step including at least one of fs-LID, CID, SID, IRMPD, UVPD, ECD ETD, Post-Source Decay ("PSD"), Electron Ionization Dissociation ("EID"), Electronic Excitation Dissociation ("EED"), Electron Detachment Dissociation ("EDD"), and/or Metastable Atom-activated Dissociation ("MAD"), in the same equipment.

In order to overcome limitations of conventional devices, the present application provides an advantageous approach to protonated peptide sequence analysis and characterization, involving the use of ultrashort laser pulses for nonergodic energy deposition and multistage dissociation in a quadrupole ion trap mass spectrometer. In one aspect of the present application, peptide solutions in methanol/water/acetic acid are introduced to the mass spectrometer by electrospray ionization, then selected precursor ions are isolated and subjected to MS/MS and $MS^3$ by fs-LID or CID.

The present system significantly improves the structural analysis of modified proteins by the introduction of a femtosecond laser into an ion-trap mass spectrometer. The goal is to take advantage of ultrafast activation, i.e. faster than intramolecular energy redistribution, in order to control the ionization and fragmentation processes. Pulse shaping, in this context, provides in-situ selective fragmentation of specific bonds within a peptide. Binary shaped laser pulses are highly effective in controlling the fragmentation of volatile compounds, and when coupled to an ionization source compatible with the introduction of biomolecules into the gas-phase, provides hitherto unavailable structural information for protein sequencing (proteomics), metabolite recognition (metabolomics), lipid characterization (lipidomics) and target-binding recognition such as protein-ligand, and protein-protein interactions (drug design). A shaped femtosecond laser of the present invention can control the ionization and dissociation processes of isolated ions in the gas-phase due to its ability to deliver energy in a timescale faster than intramolecular energy relaxation. This improves two aspects of biological mass spectrometry: Providing greater sequence coverage than conventional methods such as collision induced dissociation, and improving the analysis of modified proteins by avoiding loss or scrambling of the modification group. The acquisition of reproducible dissociation in the mass spectrometer harnesses the ability to deliver transform limited pulses, i.e., without spectral phase distortions, at the ion-packet within the ion trap of a mass spectrometer.

Simple fragmentation of ions by using short wavelength laser sources in the UV and sometimes in the near UV (400 nm) is well known. For these fragmentation processes to occur it is important for the ion of interest to have at least some portion of its molecular structure include a chromophore or region which by itself has an absorption in the UV-Vis wavelength. In such cases absorption of one or two photons deposits energy in the molecule leads to bond dissociation. The amount of energy will equal that of one or at most two photons which in this case will be less than 10 eV. The drawback to this approach is that short-wavelength laser wavelengths are difficult to generate especially with high energy per pulse. In addition, the molecule or ion must absorb the incident wavelength. It would be advantageous to use an approach that can be used with all molecules and ions without requiring that they absorb the incident wavelength. This approach becomes accessible with ultrafast (preferably less than 1 picosecond and more preferably less than 60 femtosecond) laser pulses of the present disclosure, especially those that have longer wavelengths (from near-infra red 700 nm and longer in the infrared 1 to 2 μm).

The present system's use of ultrafast laser pulses opens a new approach to ion activation. The interaction of an ultrafast laser pulse and an ion is very different from that of a nanosecond laser pulse, especially when the photon energy is much smaller than the ionization potential. In general, ionization of a neutral molecule or further ionization of a trapped ion requires 7-9 eV of energy. This energy can be provided through a nonlinear optical interaction between a long wavelength laser (with energy much smaller than that required for ionization) and the molecule. One may loosely divide the character of the intense-laser nonlinear optical ionization into (a) multi-photon ionization, (b) tunneling ionization and (c) over-the barrier ionization. A Keldysh parameter is used for the classification. A free electron in a laser field makes an oscillating motion at the frequency of the laser. The quiver energy or ponderomotive energy is given by $$U_p = \left(\frac{F_0}{2\omega}\right)^2 \propto I_0\lambda^2 \text{ where } F_0 = \left(\frac{I_0}{3.51\times10^{16}}\right)^{1/2}$$

and ω is the angular frequency of the laser electric field, or alternatively $I_0$ and λ are the intensity and the wavelength of the laser field. The Keldysh parameter is proportional to the ratio between the binding energy, $E_B$, of the electron and the ponderomotive energy. It is defined as $$\gamma = \sqrt{\frac{|E_B|}{2U_P}} \propto \lambda^{-1},$$

and it is noteworthy that the Keldysh parameter is inversely proportional to the wavelength of the laser.

γ as a function of the intensity and wavelength is then calculated. The multi-photon regime corresponds to the condition where γ>1. In the tunneling regime, scattering with the nuclear center is not important. Instead, the potential barrier formed by the core of the atom or molecule and the electric field of the laser becomes small enough for tunneling to become possible. The electron is pulled off in a field ionization process. Nevertheless, there is a difference between a static field and an oscillating field of the same magnitude. In a static field, a tunneling current will always build up. In an oscillating field, a starting tunneling current is pushed back in the next half cycle, unless it is fast enough to reach the other side of the barrier. It can be shown that the Keldysh parameter is also a measure of the ratio between the laser period and the tunneling time. Thus, when γ≈1 or smaller, the laser field can be treated as quasi-static. Generally, the tunneling formula of Amosov, Delone and Krainov (ADK theory) is considered to be a good approximation to the ionization rate.

For γ<1, ionization is in the over-the-barrier regime. In this case, the electron can escape classically from the potential well. There is, however, no sudden step in the ionization rate at the threshold for over-the-barrier ionization. Instead, the ionization rate continues to grow smoothly and continuously with increasing laser intensity.

Given a certain laser in the laboratory, a minimum value of laser intensity will be required to observe the highly nonlinear process involving over-the-barrier ionization; this is the so-called appearance intensity. At somewhat higher laser intensity, the saturation intensity, the ionization rate will have increased so much that the process saturates, i.e. the ionization probability approaches 1. For femtosecond lasers, the over-the-barrier regime is significant. At the classical threshold, the ionization lifetime, i.e. the inverse of the ionization rate, is of the order of 10-100 fs.

Therefore, activation of trapped ions is best achieved by using ultrafast long-wavelength pulses in the present system rather than by using conventional UV-Vis lasers (although certain of the present Claims may not be so limited). The activation proceeds through over-the-barrier ionization. The ion of charge n is ionized to produce a radical ion of charge n+1. The newly created ion can also acquire additional energy which leads to fragmentation. The processes that become available with ultrafast lasers with long wavelengths can be used for (i) altering the charge of trapped ions via removal of electrons and to (ii) fragment trapped ions in a time scale that is much faster than intramolecular vibrational relaxation. Fast fragmentation of ions is desirable when the ions have both strong and weak chemical bonds. Unlike slow fragmentation processes like collision induced dissociation in which there is a thermal or statistical distribution of energy, ultrafast fragmentation prevents the redistribution of energy. In slow fragmentation the weak bonds break preferentially and strong bonds cannot be broken. In contrast, in the fast fragmentation of the present system, strong bonds are broken and weak bonds are left intact. This latter case is important for the analysis of post-translational modifications ("PTM") of proteins. PTM's have been linked to specific diseases, to aging and as markers for stress. Therefore PTM analysis is beneficial for marker elucidation, for diagnostic purposes, and for monitoring the progression of a disease. It is also noteworthy that over-the-barrier ionization of polyatomic molecules becomes more efficient when circularly polarized femtosecond lasers are used.

Pulse characterization and compression are preferably employed with another aspect of the present invention. With the pulse shaper, the pulse duration is controlled and the pulses are tailored to explore the parameter space that provides the desired level of bond dissociation. Additional advantages and features of the present invention will become apparent from the following description and appended Claims, taken in conjunction with the accompanying drawings.

DETAILED DESCRIPTION OF THE PREFERRED EMBODIMENTS

Figure 1:
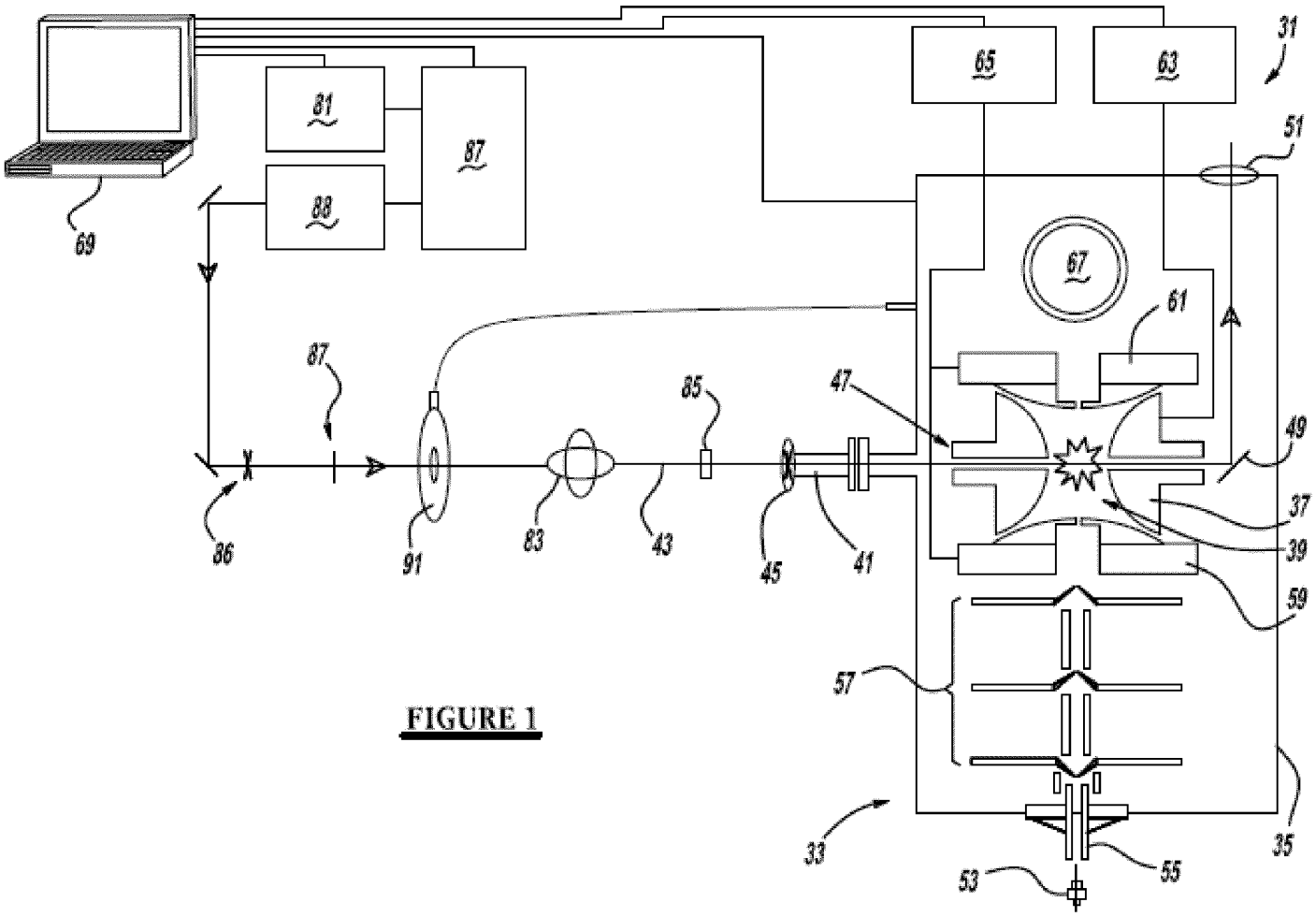
FIG. 1 is a diagrammatic view showing a laser system and a modified, three dimensional, fs-LID ion-trap mass spectrometer used in the system of the present invention.

Referring to FIG. 1, a preferred embodiment of the ultrafast laser system 31 of the present invention includes a 3D ion-trap mass spectrometer 33 (model LCQ Deca XP Plus, Thermo Scientific, San Jose, Calif.) modified using the following specific conditions: a ½" hole is drilled through the left hand side of a vacuum manifold 35 at a 60° downward angle, in line with the center of a ring electrode 37 of an ion-trap 39, and an aluminum conflat nipple is welded to the manifold. A series of ½" KwikFlange components are used to construct a vacuum-sealed entrance port 41 for a laser pulse 43, capped with a 1" diameter fused silica window 45. A 5 mm hole 47 is drilled through ring electrode 37 of the ion-trap, and quartz spacers on either side of the ring electrode are notched to allow clear passage of the laser pulse through the ion-trap. A silver mirror 49, mounted on a custom-cut aluminum block, is then fixed to vacuum manifold 35 on the far side of the trap to direct laser beam pulse 43 out a ½" diameter hole (capped with another 1" diameter fused silica window 51) drilled through the back of the vacuum manifold. The original helium gas flow regulator is removed and replaced with a manual flow controller (Porter, model VCD 1000) to allow for re-optimization of the helium gas pressure inside the ion-trap to account for increased leakage through the newly-drilled holes. Optimal performance (i.e., similar sensitivity, mass resolution and collision induced dissociation efficiency to that obtained in the unmodified instrument) should be achieved when the ion gauge pressure is between $2.5\times10^{-5}$ and $3.0\times10^{-5}$ Torr.

An electrospray ionization ("ESI"), matrix assisted laser desorption ionization ("MALDI"), desorption electrospray ionization ("DESI"), or other precursor ionized specimen source 53 is provided. For example, a syringe pump containing the ionized specimen is mounted to a receptacle 55 of mass spectrometer 33, adjacent ion transfer optics 57. Entrance and exit endcap electrodes, 59 and 61, respectively, are located between optics 57 and ring electrode 37. Furthermore, a main RF power supply 63 is electrically connected to ring electrode 37 for trapping the ions, and a supplemental RF frequency synthesizer 65 is electrically connected to endcap electrodes 59 and 61 for isolating precursor ions and/or for CID processing. A mass spectrum detector 67 is located adjacent exit endcap electrode 61, which sends sensed mass charge information to a computer controller 69 electrically connected thereto. Frequency synthesizer 65, power supply 63 and electrospray source 53 are also directly or indirectly electrically connected to and automatically controlled by computer 69.

Figure 2:
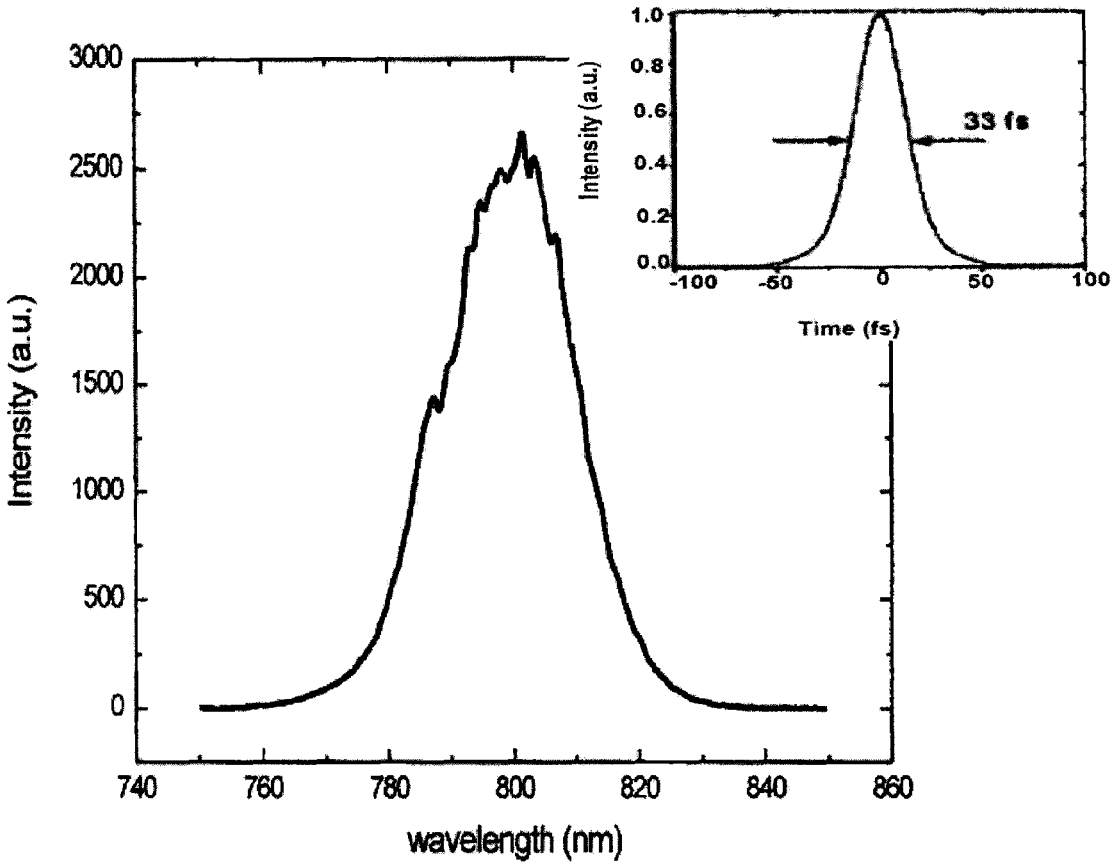
FIG. 2 shows an expected Ti:Sapphire laser spectrum, illustrating the broad bandwidth of the ultrafast laser source, for the present invention system.

The output of a regeneratively amplified Ti:$Al_2O_3$ laser (Spitfire—Spectra Physics, Mountain View, Calif.), seeded with a broadband Ti:$Al_2O_3$ oscillator 81 (KM Labs, Boulder, Colo.) operated at a 1 kHz repetition rate, with a 35 fs pulse duration and a 26 nm bandwidth centered at 800 nm, is attenuated to 300 μJ/pulse and focused into the mass spectrometer using a periscope 83 and an optic member 85, such as a f=400 mm lens. An iris optic member 86 and filter 87 are also employed. Spectral phase distortions are measured at the sample and compensated using a MIIPS Box Pulse Shaper 88 from Biophotonics Solutions, Inc. (East Lansing, Mich.), resulting in transform limited pulses passing through an amplifier 89 as shown in FIG. 2. Such a Multiphoton Intrapulse Interference Phase Scan ("MIIPS") system is disclosed in PCT Patent Publication Nos. WO 2006/088841, entitled "Ultra-Fast Laser System," and WO 2007/008615, entitled "Control System and Apparatus for Use with Ultra-Fast Laser," both of which were invented by M. Dantus et al., and are incorporated by reference herein. Alignment of the laser beam with the ion packet is fine tuned using a pair of adjustable mirrors on the periscope, and by monitoring the laser output through the exit hole located at the back of the MS instrument to ensure unobstructed passage through the closed vacuum system.

The laser is triggered using a Uniblitz LS-series shutter 91 (Rochester, N.Y.) controlled from the advanced Diagnostics menu within the Tune Plus window of Xcalibur software to generate a TTL output signal from TP_15 of the mass spectrometer to the shutter controller during the ion activation time period of a specified MS/MS or $MS^3$ experiment. Under the tab labeled 'Triggers' within the Diagnostics menu, the trigger location is set to 'activation' and the scan position is set to '0' to generate a TTL pulse at the beginning of the activation period of an fs-LID-MS/MS experiment, but not during subsequent activation periods, or at to generate a TTL pulse at the beginning of each activation time period for an $MS^3$ experiment (i.e, fs-LID-MS/MS/fs-LID-$MS^3$). Alternately, a CID-MS/MS/fs-LID-$MS^3$ experiment may be performed by setting the scan position to '1'. The 'open' time for the shutter could be set independently of the MS/MS or $MS^3$ activation time period. For this preferred embodiment, however, the shutter timing and the MS/MS or $MS^3$ activation time periods are identical.

Angiotensin II (DRVYIHPF) is purchased from Sigma Aldrich and used without further purification. The model synthetic phosphopeptide GAILpTGAILK (pTK) is prepared and samples (10 μM) dissolved in methanol/water/acetic acid (50:50:1) are introduced to the mass spectrometer by electrospray ionization using the syringe pump operated at a flow rate of 3 μL/min, a spray voltage of 4.0 kV, a heated capillary temp of 200° C., a tube lens offset of 40 V and a capillary voltage of 35 V.

Figure 5:
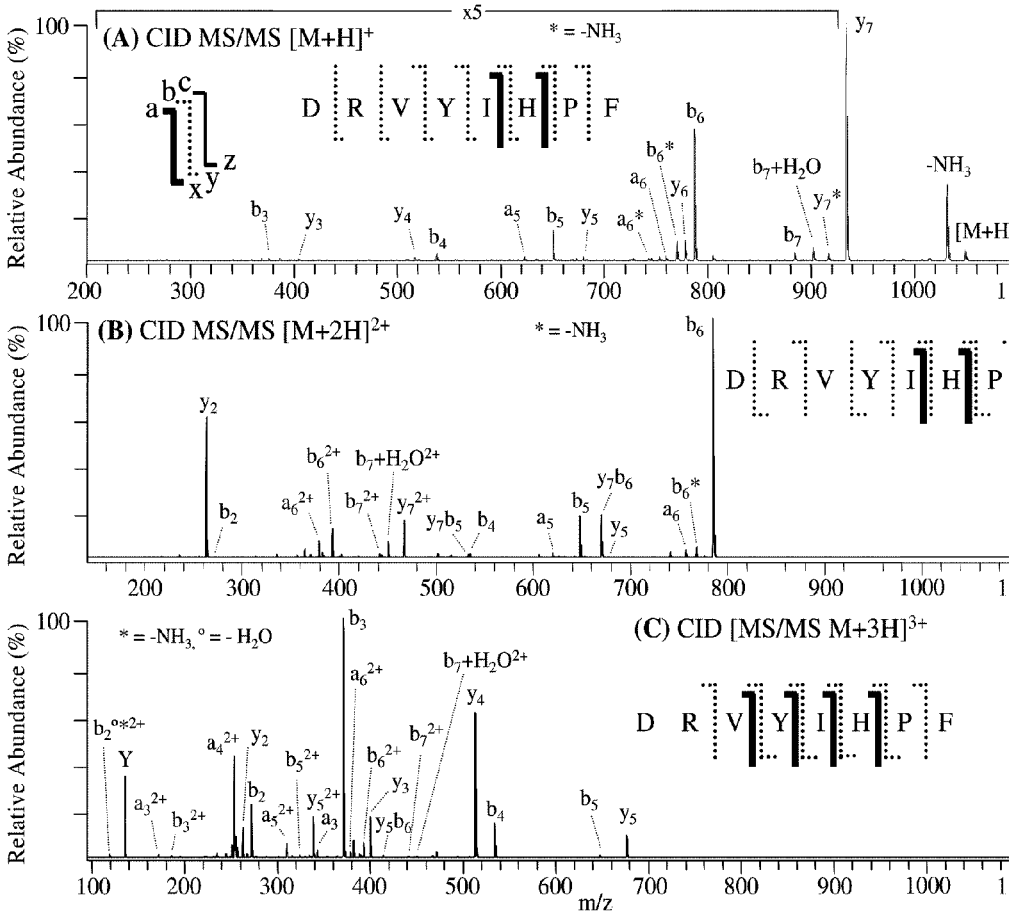
FIG. 5 shows expected CID-MS/MS of the (A) $[M+H]^+$, (B) $[M+2H]^{2+}$ and (C) $[M+3H]^{3+}$ precursor ions of angiotensin II, for the present invention system.

Ion-trap fs-Laser induced Ionization/Dissociation (fs-LID) and collision induced dissociation ("CID") MS/MS and $MS^3$ experiments are performed on mass selected protonated precursor ions, using an isolation width of 4-6 m/z, and an activation q-value of 0.17, unless otherwise stated. In order to obtain product ion spectra with good signal-to-noise, fs-LID MS/MS and $MS^3$ spectra are collected using an irradiation period of 200 msec. CID MS/MS and $MS^3$ spectra are collected using an activation time of 30 msec. The fs-LID spectra shown are the expected average of 500 scans, while CID spectra are the expected average of 200 scans (3 microscans/scan). All spectra are shown in profile mode and a 5 point Gaussian smooth is applied to all spectra. Repeated analysis of expected individual samples results in less than 5% variation in relative product ion abundances. For high resolution zoomscans of isolated $[M+2H]^{2+}$ and $[M+H]^{2+\bullet}$ ions of angiotensin II, the automatic gain control (AGC) target is set to $1\times10^6$.

fs-LID of the $[M+H]^+$ precursor ion of angiotensin II (FIG. 3A) should yield 23 of the 42 possible a-, b-, c-, x-, y- and z-type 'sequence' product ions, from which 100% sequence coverage is obtained. In comparison, the CID spectrum obtained from the same precursor ion is dominated by selective cleavage at the C-terminal side of the aspartic acid residue to yield the $y_7$ ion (FIG. 5), and should yield only (12 of 42 possible sequence ions).

Figure 3:
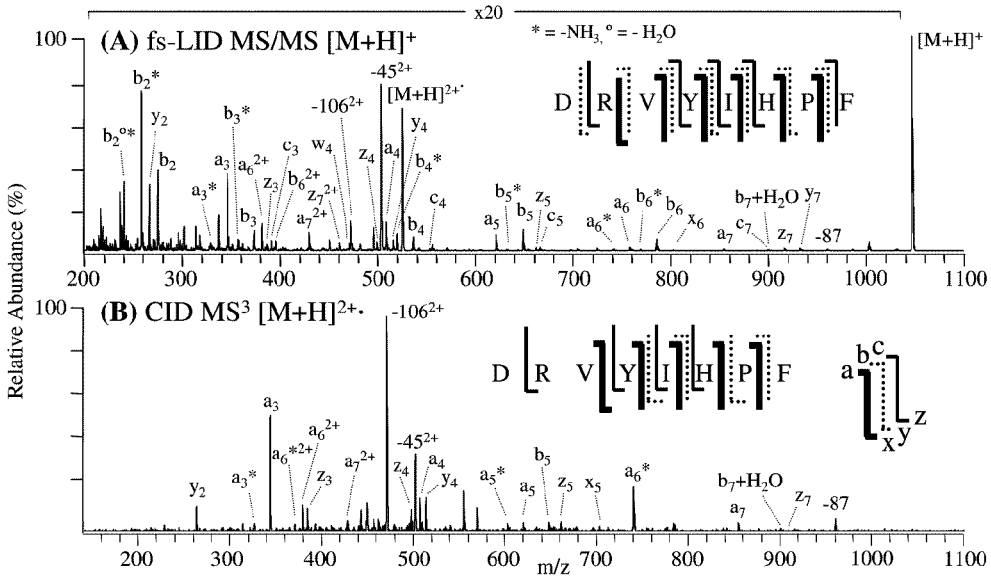
FIG. 3 shows expected results at (A) fs-LID of the $[M+H]^+$ precursor ion of angiotensin II, and at (B) CID $MS^3$ of the $[M+H]^{2+}\bullet$ photoionization product from panel A, for the present system.
Figure 6:
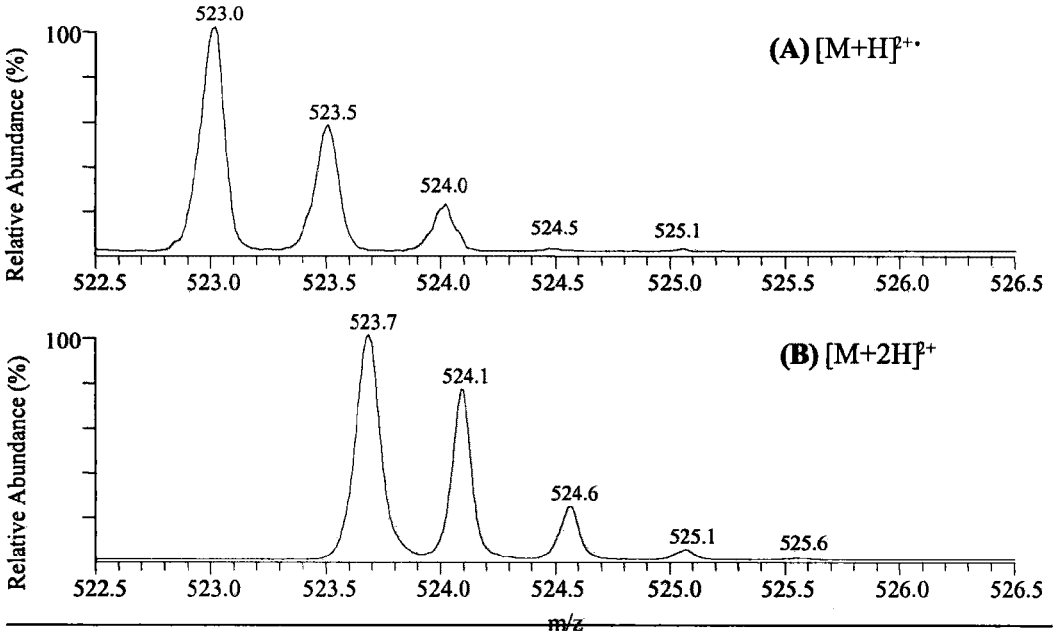
FIG. 6 shows expected high resolution zoomscan spectra of (A) the isolated $[M+H]^{2+}\bullet$ photoionization product ion of angiotensin II from FIGS. 3A, and 3B the isolated $[M+2H]^{2+}$ precursor ion of angiotensin II, for the present invention system.
Figure 7:
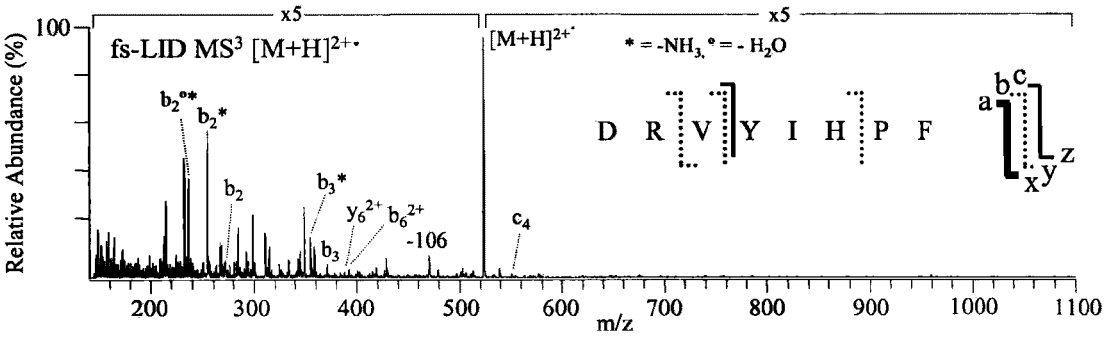
FIG. 7 shows expected fsLID-$MS^3$ (q=0.25) of the $[M+H]^{2+}$ photoionization product of angiotensin II from FIG. 3A, for the present invention system.

Notably, an odd electron doubly charged ($[M+H]^{2+}\bullet$) product ion should be observed in FIGS. 3A and 6, via photoionization of the even electron singly protonated precursor. $[M+H]^{2+}\bullet$ions have previously been produced by electron ionization or as Penning ionization products following metastable ion activation. However, these ions have not previously been observed via conventional photoionization techniques, and their involvement in the dissociation pathways responsible for the formation of sequence type product ions have not previously been reported. CID-$MS^3$ (FIG. 3B) and fs-LID $MS^3$ (FIG. 7) reveal that the majority of the product ions to be observed in FIG. 3 are indeed formed from this species. Other product ions formed via the losses of p-quinomethide (−106) and COOH• (−45), indicative of specific side chain functional groups in the peptide are also observable in FIG. 3A.

Figure 4:
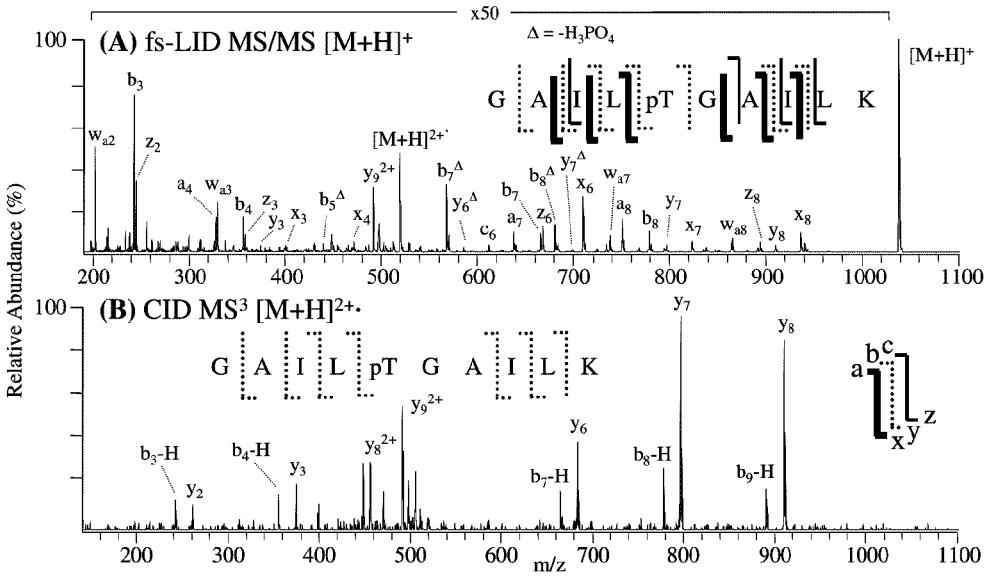
FIG. 4 shows expected results at (A) fs-LID of the $[M+H]^+$ precursor ion of GAILpTGAILK, and at (B) CID $MS^3$ of the $[M+H]^{2+}\bullet$ photoionization product from panel A, for the present invention system.
Figure 8:
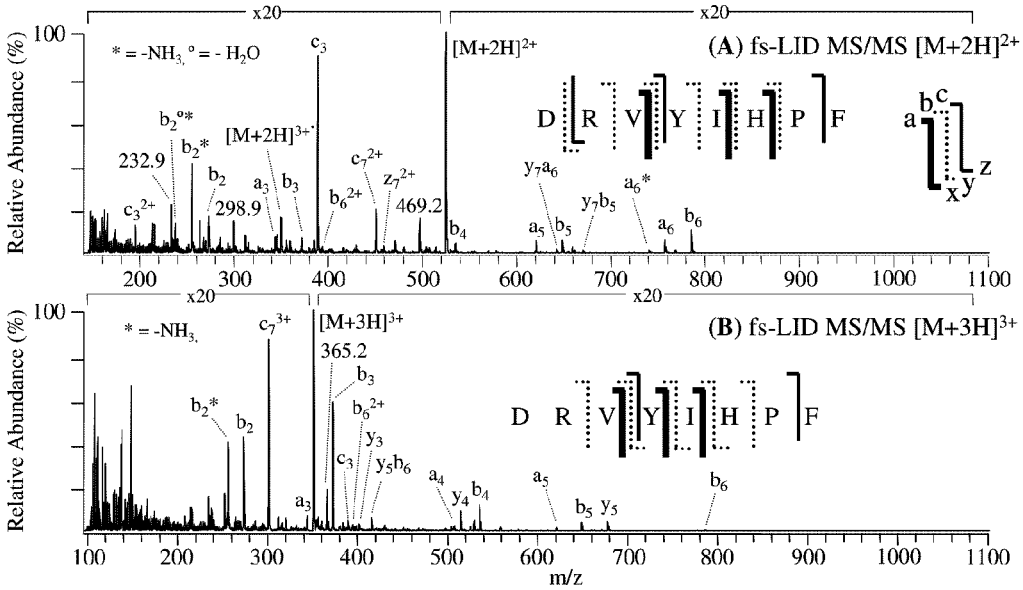
FIG. 8 shows expected CID-MS/MS of (A) the $[M+H]^+$ and (B) $[M+2H]^{2+}$ precursor ions of the model synthetic phosphothreonine containing peptide GAILpTGAILK (pTK), for the present invention system.
Figure 9:
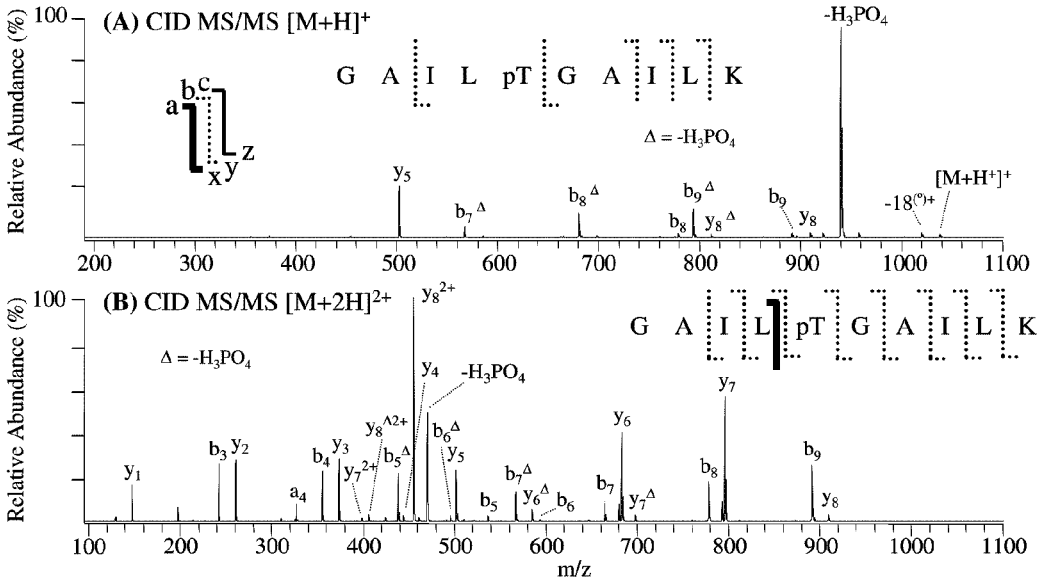
FIG. 9 shows expected fsLID-$MS^3$ (q=0.25) of the $[M+H]^{2+}\bullet$ photoionization product of the model synthetic phosphothreonine containing peptide GAILpTGAILK (pTK) from FIG. 4A, for the present invention system.
Figure 10:
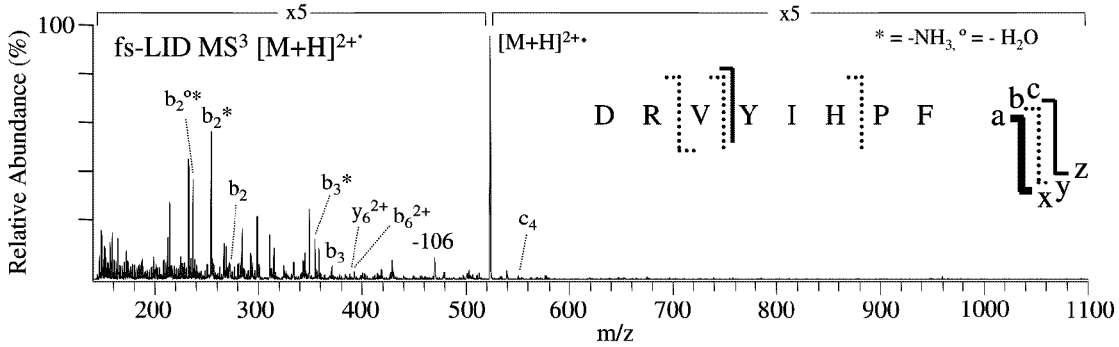
FIG. 10 shows expected fsLID-MS/MS of the (A) $[M+2H]^{2+}$ and (B) $[M+2H]^{2+}$ precursor ions of angiotensin II, for the present invention system.
Figure 11:
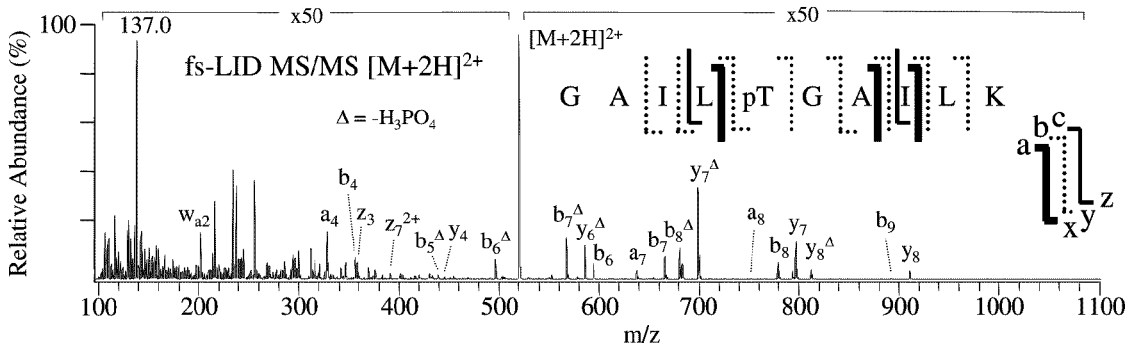
FIG. 11 shows expected fsLID-MS/MS of the $[M+2H]^{2+}$ precursor ion of the model synthetic phosphothreonine containing peptide GAILpTGAILK (pTK), for the present invention system.

To assess the utility of fs-LID for the characterization of peptide post-translational modifications, the fragmentation reactions of the $[M+H]^+$ precursor ion from a model synthetic phosphopeptide GAILpTGAILK (pTK)[4] is examined. CID MS/MS of this peptide (FIG. 8) should result in the dominant loss of $H_3PO_4$, precluding the ability to assign the site of phosphorylation. However, it can be seen from FIG. 4 that 100% sequence coverage is obtained upon fs-LID (21 of the 54 possible a-, b-, c-, x-, y- and z-type 'sequence' product ions), with only minimal loss of the phosphate group. Similar to that discussed above for angiotensin II, an $[M+H]^{2+}\bullet$ product ion is also observed for the pTK peptide. CID-$MS^3$ and fs-LID $MS^3$ (FIG. 4B and FIG. 9, respectively) again reveals that the majority of the observed product ions in FIG. 4A are formed via this product. The fs-LID technique is also generally applicable to the analysis of multiply protonated precursor ions, as shown for the $[M+2H]^{2+}$ and $[M+3H]^{3+}$ precursor ions of angiotensin II (FIG. 10) and the $[M+2H]^{2+}$ precursor ion of pTK (FIG. 11). In each case, fs-LID activation provides additional product ions compared to CID (FIGS. 5 and 8), thereby providing increased confidence for assignment of the peptide sequence.

Figure 14:
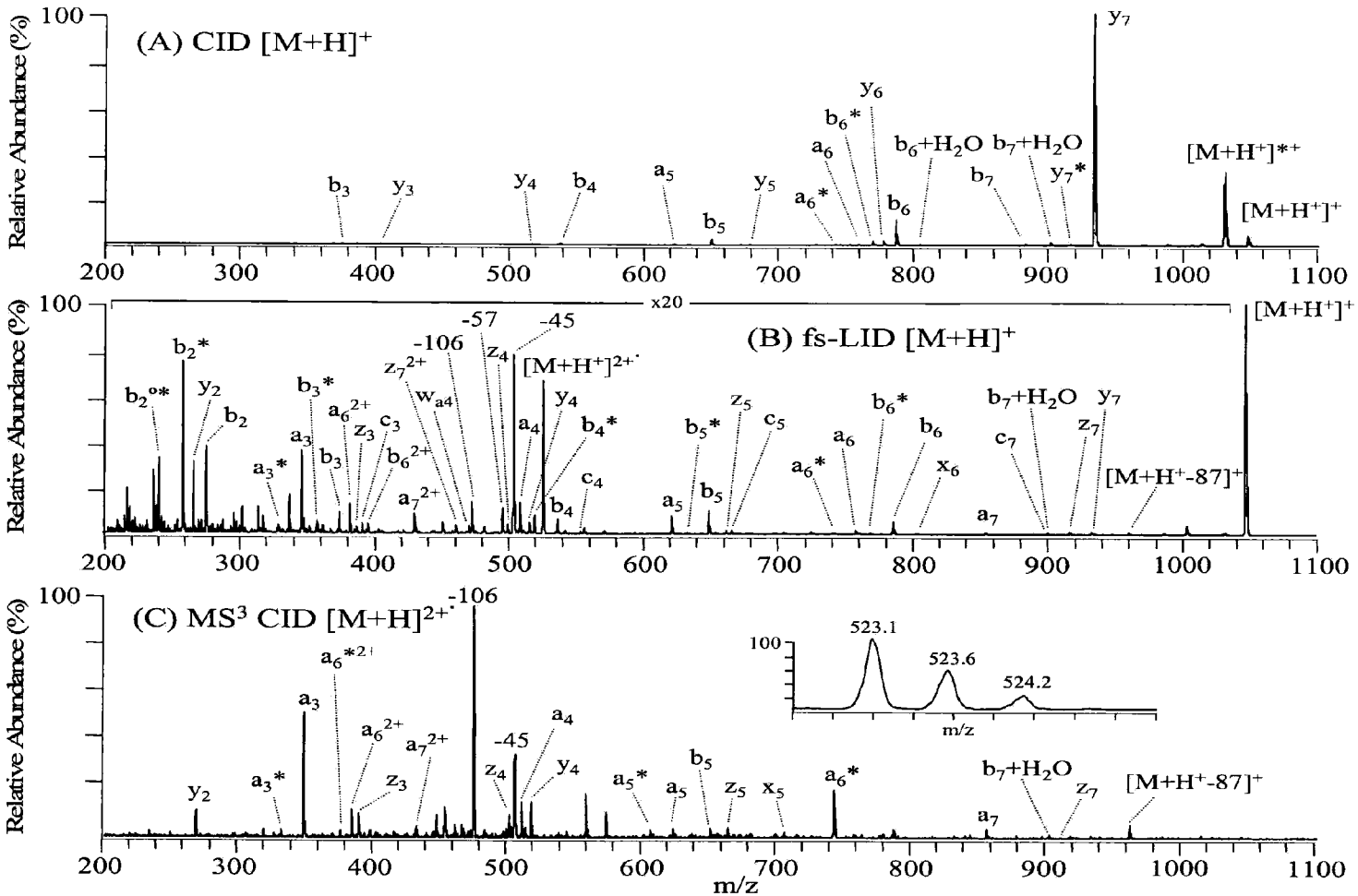
FIG. 14 shows at (A) an expected CID spectrum of angiotensin II, at (B) an expected fs-LID spectrum under the same conditions showing a much greater degree of sequence specific bond cleavage, and generating a doubly charged radical molecular ion product, and at (C) an expected $MS^3$ CID spectrum of the fs-LID doubly charged radical ion for the present invention system.

The present fs-LID MS system and method achieves photodissociation of structurally important chemical bonds in large biomolecules. In FIG. 14, a comparison of expected results is presented between conventional CID and the present fs-LID on the isolated singly protonated precursor ion of angiotensin II (10 μM in methanol/water/acetic acid (50:50:1)). Fs-LID spectra is accumulated over 15 minutes using 200 ms irradiation periods, and reference CID spectra is collected at matching q-values. The CID spectrum (FIG. 14A) should provide ~17 assignable peaks. In contrast, fs-LID of the $[M+H]^+$ precursor ion (FIG. 14B) should provide more than 40 assignable peaks. The spectrum is particularly information-rich, especially when compared to the traditional CID spectrum to be collected under identical conditions, where fragmentation favored formation of the $y_7$ ion as well as ammonia loss from the singly protonated precursor. Notably, CID-$MS^3$ of the abundant fs-LID $[M+H]^{2+\bullet}$ photoionization product expected to be observed at 523.1 m/z in FIG. 14B is found to give rise to many of the a and z ions observed in the $MS^2$ fs-LID spectrum (FIG. 14C. Additionally, losses of p-quinomethide (−106 Da), COOH• (−45 Da), and $[C_3H_8N_3+H]^{+\bullet}$ (−87 Da) are expected to be observed, consistent with the charge-remote fragmentation of peptide radicals previously described by (30) fs-LID $MS^3$ of the $[M+H]^{2+\bullet}$ photoionization product should reveal that many of the low-mass b-type product ions in the $MS^2$ fs-LID spectrum are generated by further electronic excitation of the $[M+H]^{2+\bullet}$ ion-radical in the strong laser field.

Hence, fs-LID is capable of significantly increasing the number of sequence-relevant bond cleavage product ions, and that it is compatible with commercial ion-trap mass spectrometers. The additional flexibility provided by fs-LID coupled to ion trap mass spectrometry is demonstrated by obtaining MS spectra with either activation method (i.e., CID or LID). It is particularly worth noting that fs-LID should create a multiply charged radical molecular ion by removal of an electron, and that dissociation of this species gives access to additional valuable sequence information. Previously, the ability to acquire this information by photodissociation techniques has required the presence of a native chromophore or the introduction of a chromphore through chemical means. Thus, a significant advantage of fs-LID over previous photodissociation approaches is that no chemical treatment or the use of chromophores is required.

Figure 15:
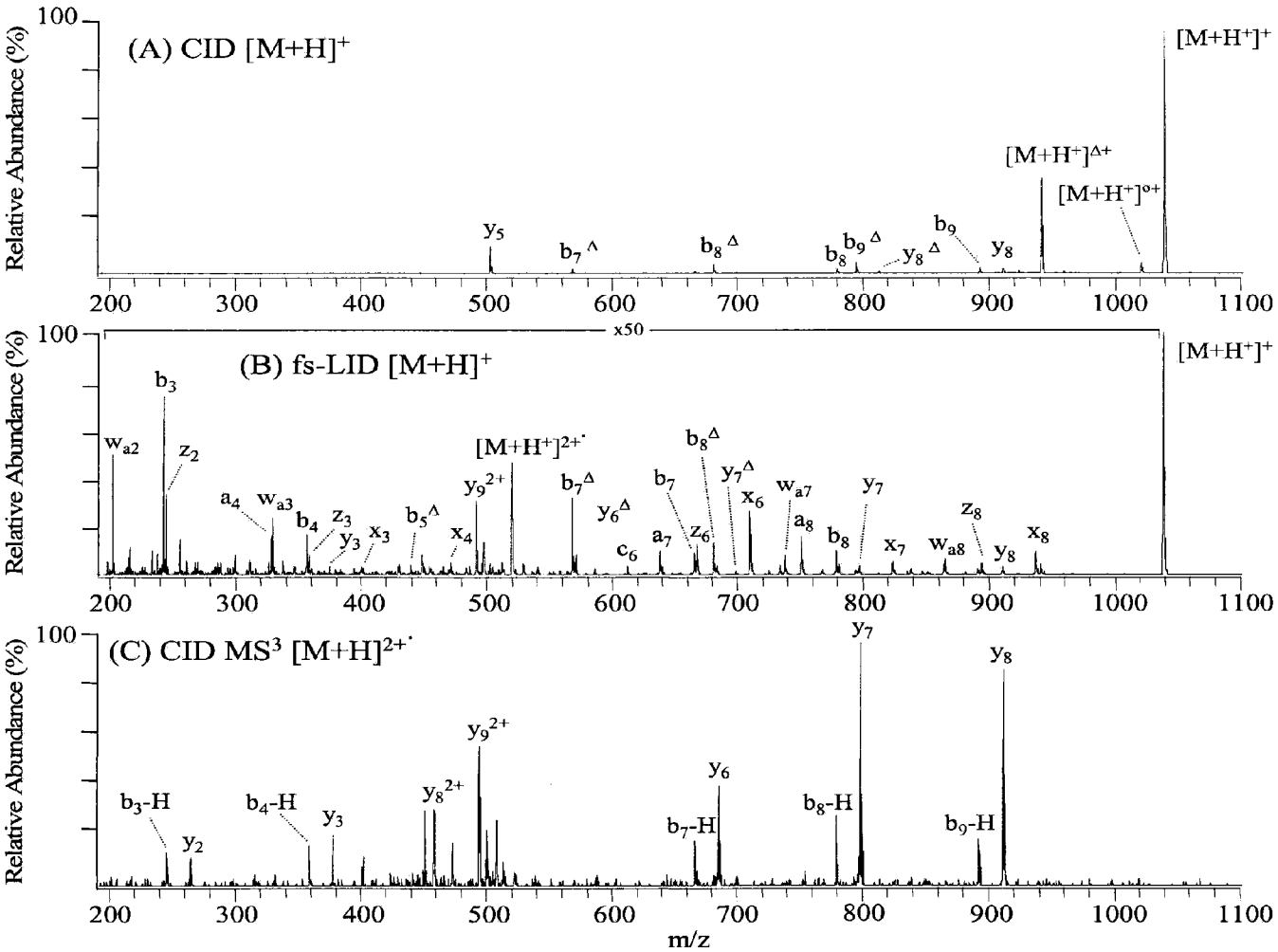
FIG. 15 shows at (A) an expected CID spectrum of pTK showing phosphate loss as the main product, at (B) an expected fs-LID spectrum under the same conditions showing a much greater degree of sequence specific bond cleavage with much fewer loss of the phosphate group and generating the doubly ionized molecular ion-radical, and at (C) an expected $MS^3$ CID spectrum of the fs-LID doubly charged ion-radical for the present invention system.

In addition, fs-LID can also achieve photodissociation of modified peptides without losing valuable information about the specific location of the modification. CID-MS/MS of the singly protonated precursor ion of a model synthetic phosphopeptide GAILpTGAILK (pTK) (10 μM in methanol/water/acetic acid (50:50:1)) leads primarily to loss of 98 Da ($H_3PO_4$), indicated in the expected spectrum by the Δ symbol (FIG. 15A). Most of the product ions have lost the phosphate group. Only the $y_5$, $b_9$ and $y_8$ product ions preserve the phosphorylation. The reason why the phosphate groups (as well as many other protein modifications) are lost during conventional CID is that the activation process is ergodic, proceeding from weaker to stronger bonds. Given that many modifications have weaker bonds; these are lost early in the conventional CID process. In addition, the modifications may be prone to migration within the peptide, especially when the peptide gains energy through the CID process. This scrambling of information makes the correct assignment of protein modifications very challenging by CID. FIG. 15B, however, presents expected result by fs-LID under identical ion-trap conditions as those used for CID. Here, exposure the intense field of the femtosecond laser cause extensive backbone cleavage in which the majority of the fragments (>80%) retain the phosphate modification. More impressive is the expected $MS^3$ data in which the doubly charged radical ion generated by fs-LID is then subjected to CID. In this case, shown in FIG. 15C, 100% of the fragments are expected to maintain the phosphate group.

The present invention is more specifically employed to quantitatively evaluate the use of phase optimized fs-LID for protein sequence analysis. In other words, to initiate the optimization of phase-shaped laser pulses to promote diagnostically useful fragmentations such as those involving cleavage of selected bonds within peptide or protein ions. These cleavages may result in the formation of N-terminal b- and C-terminal y-type ions via cleavage of the peptide C—N amide bonds, or a-, c-, x- and z- type ions resulting from cleavage of the N—C or C—C bonds along the peptide backbone. It is especially desirable to obtain a complete series of these product ions because the mass difference between consecutive members of a series of such ions corresponds to the mass of an amino acid residue, thereby allowing the sequence or primary structure of the peptide or protein to be determined.

Figure 19:
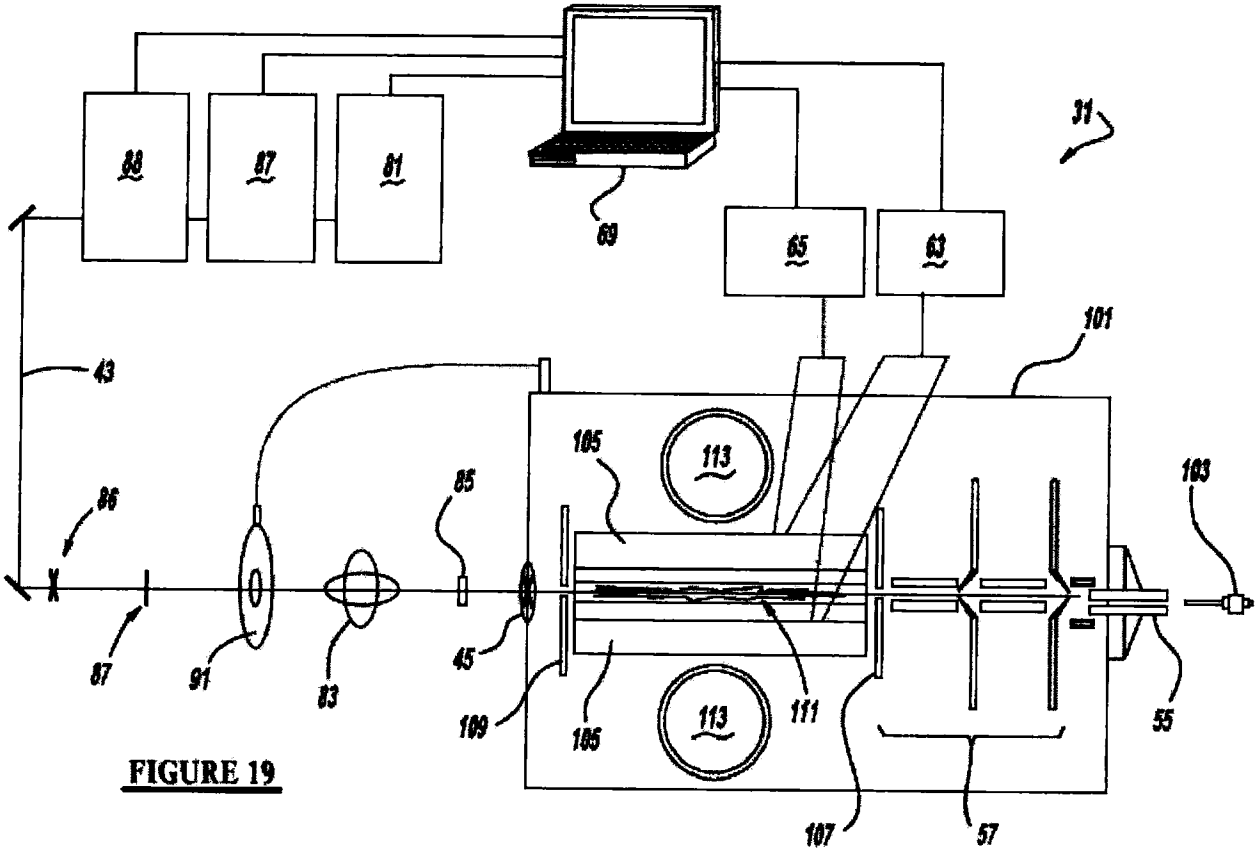
FIG. 19 is a diagrammatic view showing a laser system and a linear, fs-LID ion-trap mass spectrometer used in the system of the present invention.

The method of using this present system for such analysis is as follows. Peptides are introduced by infusion, or by on-line capillary RP—HPLC, directly coupled to a linear quadrupole ion trap mass spectrometer 101 (see FIG. 19) (Thermo model LTQ, San Jose, Calif., USA) equipped with a nanospray ionization (nanoESI) source 103. Quadrupole rods 105, an entrance electrode 107 and an exit electrode 109 define a linear ion-trap 111 therein. A pair of mass spectrum detectors 113 are also provided. Individual precursor ions are isolated and subjected to CID or fs-LID. The current instrument configuration allows for selection of either CID or fs-LID at any stage of the analysis, thus providing great flexibility for experimental ion characterization.

The laser is first optimized to deliver transform-limited pulses with 35 fs in duration, with 28 nm bandwidth centered around 800 nm to the 3D ion trap. Cancelation of phase distortions is achieved using the MIIPS software. The laser is operated at a 1 kHz repetition rate and the beam attenuated to 300 μJ/pulse (300 mW average power) and focused into the ion trap with a peak power of approximately $3\times10^{13}$ W/cm$^2$ at the center of the trap. These conditions should deliver good quality spectra after a single 300 ms activation window. Averaging of several such spectra should increase the reproducibility of peak heights.

In a further embodiment, the present invention is more specifically employed to apply fs-LID to the improved identification and characterization of post-translational modifications in proteins from a biological source, starting with phosphorylation. The true value of the fs-LID methodology for accelerating human health research can be judged from its ability to generate useful information about important modified proteins derived from a biological source. The greatest challenges in PTM characterization are presented in the form of PTMs in large (>2000 Da) tryptic peptides with multiple possible modification sites. These frequently yield conventional CID fragmentation that is inadequate to localize a PTM.

Femtosecond laser induced ionization and dissociation leads to the formation of a large number of product ions, even in the absence of a native or chemically introduced chromophore. Analysis of the product ions reveals much more complete sequence coverage together with a much greater number of product ions that confirm the amino acid sequence and therefore increase the success rates when using an automated spectral analysis database. Furthermore, in contrast to the conventional method of collision induced dissociation, which often leads to extensive phosphate group loss or phosphate group scrambling of phosphorylated peptides, fs-LID of the present system leads to minimal loss of the phosphate group. Furthermore, fs-LID and CID can be used in the same instrument and are mutually compatible, thereby allowing $MS^3$ experiments in any combination, e.g., isolation:fs-LID:isolation:CID, and isolation:fs-LID:isolation:fs-LID, isolation:CI D:isolation:fs-LI D. The fs-LID technology provides the potential to deposit energy into selected ions in an efficient and controlled fashion independent of ion charge environment. This approach provides access to different kinds of ions that can undergo fragmentation through channels not available through conventional ion activation technologies. Such a technology offers substantial expansion of the ability to measure key regulatory events in a wide range of biological processes.

For example, the present laser system allows for the quantitative evaluation of the use of phase optimized fs-LID for protein sequence analysis, and the application of fs-LID to improve identification and characterization of post-translational modifications in proteins, starting with phosphorylation.

The results provide a quantitative assessment as to the usefulness of fs-LID in biological mass spectrometry. This establishes conditions for the effective use of ultrashort pulses in mass spectrometry for improved proteomic analysis. The advantages of the present system are realized when comparing the CID MS/MS spectra of modified peptides, for example histone proteins which are subject to modifications, such as acetylation, methylation, phosphorylation, ubiquitination, glycosylation, and ADP ribosylation, some of which are known to play important roles in the regulation of chromatin structure and function, with those obtained by fs-LID. fs-LID has the ability to achieve unambiguous assignment of the modification sites within these peptides. The present system is used to independently determine the modification sites and the advantages of the present system are greatest for proteins containing multiple modification sites. Regulation proteins are known to contain more than 20 post-translation modifications. The present system, therefore, results in a powerful new mass spectrometry instrument that achieves increased sequence coverage, and unambiguous assignment of sites and identities of post-translational modifications, while avoiding time-consuming chemical processes such as the addition of a chromophore, or derivatization. The speed with which fragmentation occurs with the present system minimizes possible position scrambling and loss of the modifications of interest, resulting in greatly improved assignment.

Ultrashort laser pulses, less than 1 ps, preferably less than 60 fs and more preferably less than 30 fs, having a preferred wavelength greater than 700 nm and a preferred peak intensity greater than $10^{12}$ W/cm$^2$, can deposit energy by multiphoton transitions which are not commonly observed with conventional laser pulses and can induce field ionization. By modulating the spectral phase of ultrashort pulses, it is possible to control the amount of energy that is deposited and the subsequent fragmentation of the target ion. Essentially, the yield of each fragment ion produced is affected by the shaped laser pulses; this process non-ergodically focuses the available energy on specific chemical bonds in a timescale much faster than the rate of intramolecular energy randomization. The present system focuses a shaped femtosecond laser pulse on a designated precursor ion, and provides photodissociation fragmentation data which is used to elucidate the structure of the target ion. Pulse shaping is used to control the extent of photodissociation and to direct photodissociation to specific molecular motifs. These femtosecond laser pulses provide an attractive alternative to conventional CID methods that provide some fragmentation information but without the degree of user-directed control that will be possible with the present system. More notably, the femtosecond laser pulses of the present system avoid the thermalization process that accompanies conventional CID which leads to cleavage of the weakest bonds, and may lead to molecular scrambling in the activated species. Thus, the present system gives an active and selective energy source which providing the analyst with a 'spectroscopic scalpel' to generate structurally diagnostic fragment ions never before available for the elucidation of protein structure.

fs-LID of the present system further ionizes a precursor and/or product specimen by removing at least one electron of the specimen. This is possible due to the preferred less than 1 ps duration and greater than 700 nm wavelength of the laser pulses. This desirable electron removal is not achieved by conventional CID or conventional use of laser pulses of greater durations and/or shorter wavelengths.

A major barrier to the utilization of traditional femtosecond laser pulses was the expense and typically they needed optimization by a laser expert in order to yield reproducible results. The preferred use of MIIPS in the present system overcomes conventional difficulties in measuring phase distortions and correcting for them. MIIPS is an adaptive procedure that measures and automatically eliminates spectral phase distortions in seconds. Briefly, the MIIPS method is based upon monitoring characteristic changes occurring in the spectrum of a nonlinear process, such as second harmonic generation ("SHG"), when the phase of the input pulse is altered. In MIIPS, a pulse shaper with a programmable spatial light modulator ("SLM") is used to introduce a reference phase function $f(\lambda)$, and the algorithm searches for wavelengths that satisfy the equation $\phi''(\lambda)-f''(\lambda)=0$, where $\phi(\lambda)$ is the unknown spectral phase of the laser pulse at the focal plane. Finding the values that satisfy the equation above is as simple as scanning a range of quadratic reference phase functions (amount of linear chirp) and collecting an SHG spectrum for each such phase. From the resulting spectra obtained as a function of the reference phase, the function $\phi''(\lambda)$ can be directly obtained. After its double integration, the original spectral phase $\phi(\lambda)$ is known, and a compensation phase (negative of the measured phase) is introduced to obtain TL pulses at the sample. The procedure is fully automated and takes less than a minute. Note that since the second derivative of the phase is measured and corrected for all wavelengths within the pulse spectrum rather than at a single (central) wavelength, MIIPS automatically accounts for all higher orders of dispersion. The pulse shaper that performs MIIPS is preferably placed between the oscillator and the regenerative laser amplifier, which allows for obtaining shaped pulses without loss of laser intensity. By placing the MIIPS detector near the mass spectrometer and using a window that is similar to the one at the laser input port, the system is able to compensate for phase distortions introduced by the oscillator, amplifier and even the air as the ultrashort pulses make their way to the MS system. This MIIPS technology ensures reproducible MS results.

Figure 12:
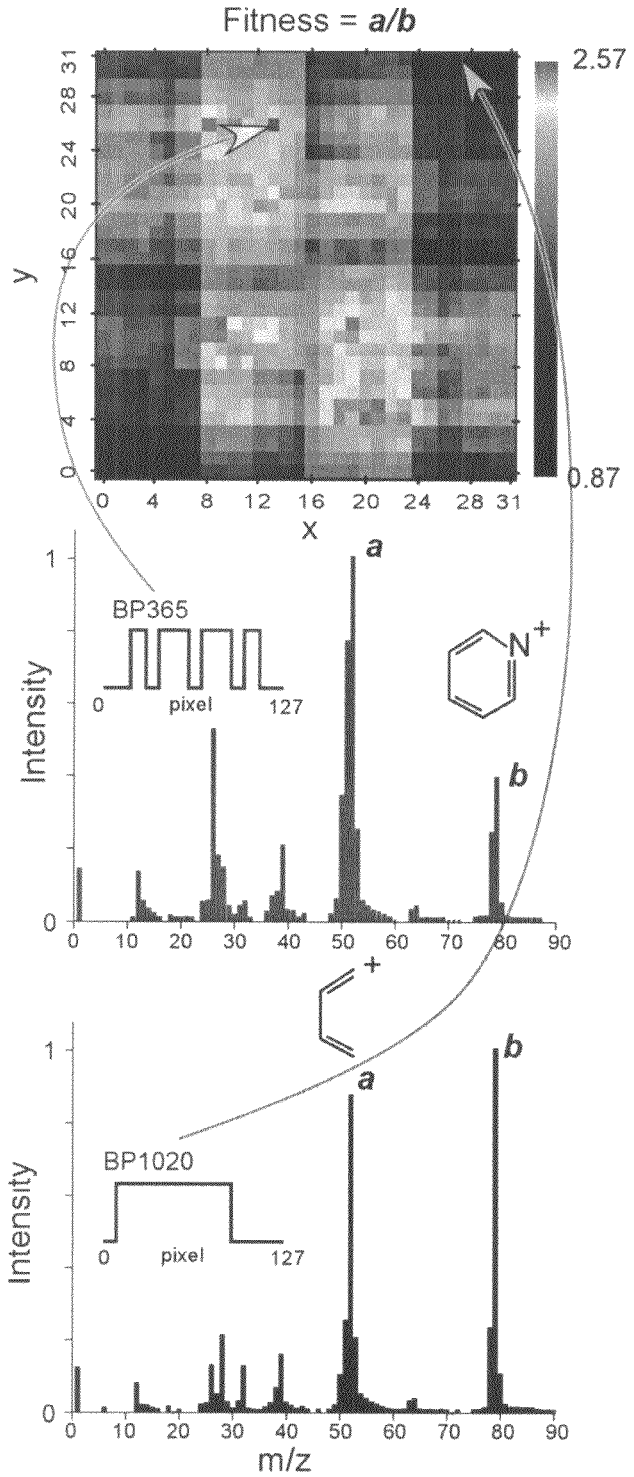
FIG. 12 is a plot showing expected results on the effect of binary phase shaping on the photodissociation of pyridine for the present invention system.

With the present system, controlled fragmentation is achieved when using binary phase shaping of femtosecond pulses, where each pixel in the pulse shaper receives a value of 0 or $\pi$. The methodology is called binary phase shaping mass spectrometry ("BP-MS"). The binary phases are identified as BP#, where the number corresponds to the decimal value of the binary code used to generate the phase. For example, the phase function 0101101101 corresponds to BP365 and 0111111100 to BP1020 (1 corresponds to retardation by $\pi$ for that pixel), as shown in FIG. 12. An advantage to the use of binary-phase shaping instead of arbitrary phase shaping is that it speeds the search for specific pulses that yield the desired bond cleavage by orders of magnitude. Expected results of a binary phase search are mapped as shown in FIG. 12, where the diagram represents the experimentally recorded search space for the binary phase control of pyridine ionization versus loss of HCN under strong field excitation. Notice that the fitness, calculated as the ratio of peaks a (m/z 52) and b (m/z 79) can be controlled from 0.87 to 2.57. The mass spectrum for two specific binary phases is shown below with their associated binary phase. The search map shows inversion symmetry; this is because addition of it to a phase function gives an equivalent phase function. Transform limited pulses, the bottom left and the upper right corners, lead to small a/b ratios where less fragmentation is observed. There may be more than one optimum solution, for example, methods for selective multiphoton excitation and for selective impulsive stimulated Raman scattering. These approaches can be used to deliver energy selectively to the molecule.

Typically, sets of experiments are programmed on the computer controller which records mass spectrometry data for each of the differently shaped laser pulses. Once the entire data set is obtained (typically about 20 minutes) the data is analyzed by plotting a particular desired outcome (for example the ratio between two fragmentation pathways) as a function of the binary phase number. As can be seen in the example given in FIG. 12, there is a large range of variation within the different shaped pulses. After testing, specific shaped pulses or pulse-sequences, which cause the desired fragmentation, are employed thereafter. Because the system can evaluate hundreds of shaped pulses per minute, this process is fast and efficient. Furthermore, once those pulse sequences are identified, they do not need to be searched again, they can be used as one would use a chemical reagent.

In mass spectrometry, multidimensional analysis is helpful for molecular identification because there are a number of chemical species that are very similar and difficult to distinguish. Molecular isomers are species with the same chemical formula but different structure. With large biomolecules this occurs often. The ability to induce structure-sensitive photodissociation greatly simplifies the task of identifying molecular isomers. For example, ortho and para-xylene have identical electron-impact mass spectra. Binary phase shaping with MS is used to identify ortho- and para-xylene, something that electron impact MS cannot.

Figure 13:
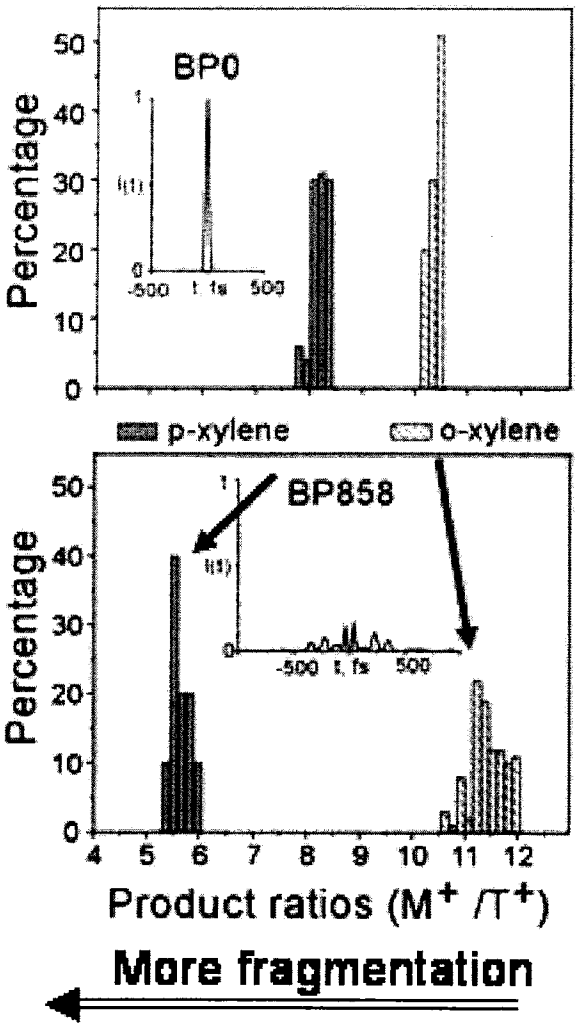
FIG. 13 shows on the left, conventional MS data for ortho- and para-xylene showing there is little or no difference in their spectra, and on the right, by using fs-dissociation o- and p-xylene are expected to be easily identified for the present invention system. Using binary phase shaping, the dissociation is much more pronounced. The expected data correspond to the ratio $M^+/T^+$ and given are the histogram from 128 expected measurements.
Figure 13:
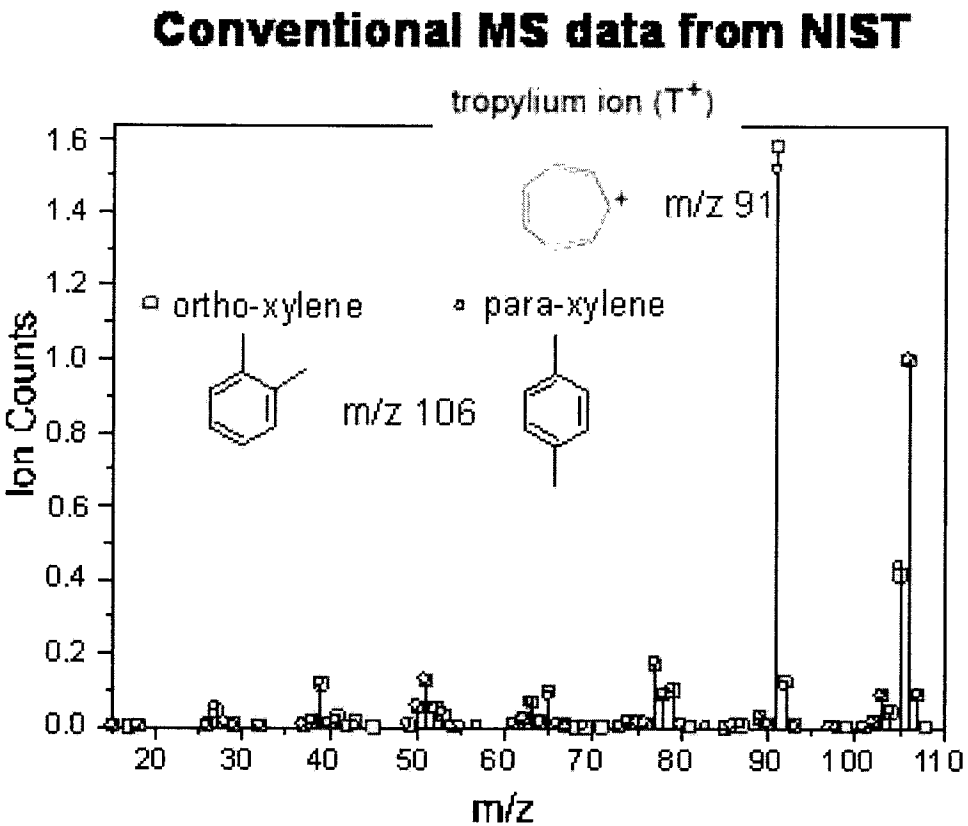

In FIG. 13, the left panel shows the expected electron impact mass spectrum obtained from both compounds. The right panels show the ratio expected to be obtained between the molecular ion and the tropylium ion are clearly different for BPO and much more different for BP858. The ratios obtained can be used to identify these two isomers. In fact, these pulse sequences are used for the fast (0.1 sec) and reliable quantification of mixtures of both of these compounds. Shaped laser pulses are used to identify among a large number of isomeric pairs (positional, geometric and even some stereoisomers). This capability is applied to mass selected peptide ions as described below. Because the energetic requirement for ionization (equivalent to six laser photons) has already been overcome when the laser interacts with ionized peptides, it is expected to gain better control over fragmentation. The greater ability to cleave chemical bonds and to determine structural information such as type of isomeric species will assist proteomic and metabolomic analysis. Unlike the use of genomic biomarkers, characterization of protein—protein signaling by identification of phosphorylation states of proteins relates directly to cellular responses during disease progression or drug treatment. Thus, the systematic identification and characterization of phosphoproteins, including determination of the specific site(s) of phosphorylation within a protein of interest and quantitative analysis of temporal changes in phosphorylation status, are helpful to the development of a more complete understanding of the role of these modifications in the onset and progression of disease, and for the development of therapeutic strategies for their treatment. The mass spectrometry-based technique improves protein identification and characterization of phosphorylation sites compared to existing technologies.

For all of the embodiments and uses disclosed herein, the ion-trap mass spectrometer preferably includes a 3D ion trap, but can alternately include a linear ion-trap, an ICR ion-trap, or an electrostatic Orbitrap, although focusing of the laser beam pulse on the ions may need to be adjusted accordingly. Moreover, quadruple or time-of-flight ("TOF") analyzers may also be used depending on the specific application. It is additionally envisioned that the present system can employ various combinations of pulse characteristics (e.g., shapes, iterations, durations, etc.) and/or other steps including CID, fs pulses, and/or less preferably electron impact methods, to the targeted specimen being analyzed. Such combinations are automatically operated by a software routine stored in memory in the programmable computer, which are responsive to initially sensed iterative results and/or predetermined calculations.

Figure 20:
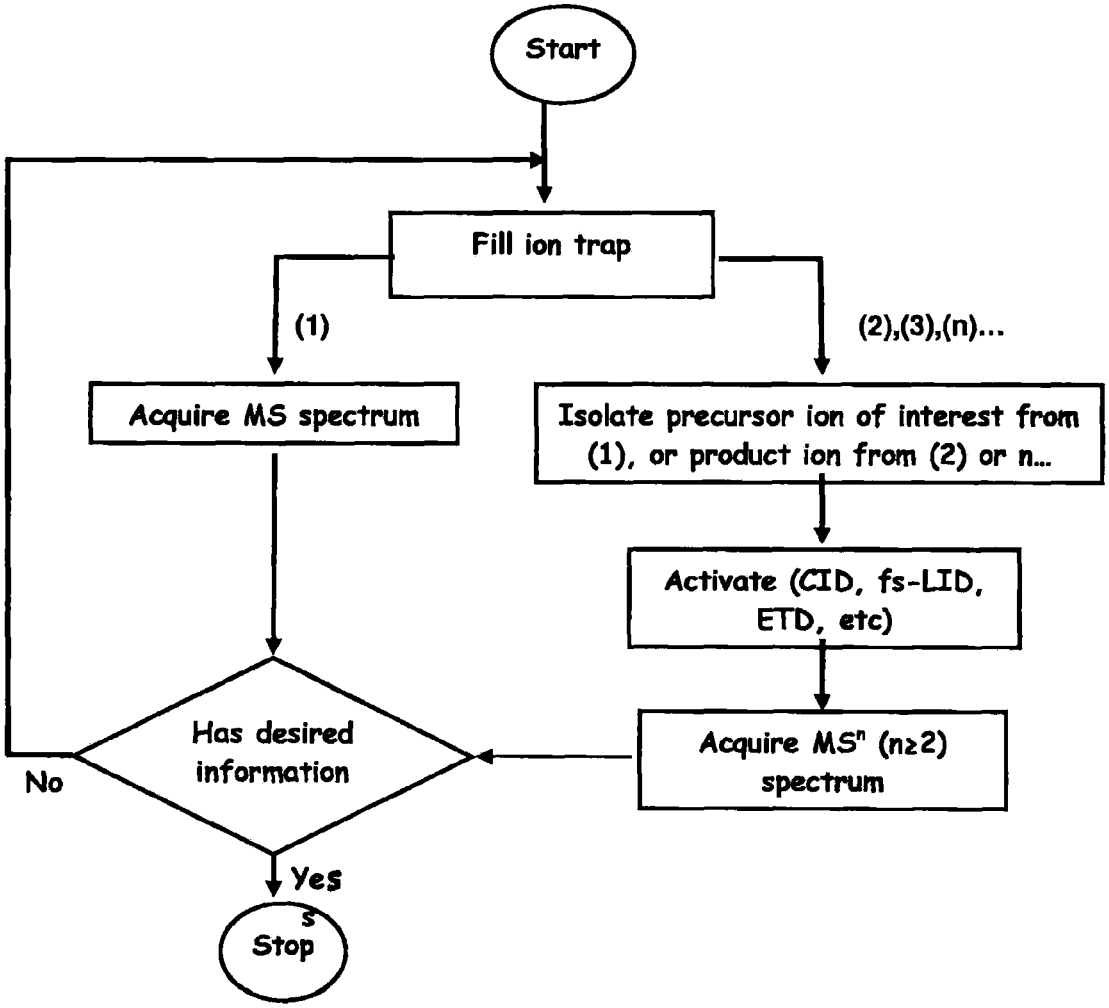
FIG. 20 is a software flow chart for the present invention system.

Referring to FIG. 20, software instructions are programmably stored in memory, such as RAM or on a disc, of a computer 69 (see FIGS. 1 and 19) which runs the software in a microprocessor. The computer includes input devices, such as a keyboard and detector(s) 67 and 113 (see FIGS. 1 and 19, respectively). Moreover, output devices, such as a display screen and printer, are attached to the computer for visually showing mass spectrum information, laser pulse shapes, duration and other characteristics, and/or operator prompts. The software provides a data-dependent acquisition of MS/MS and $MS^n$.

The software can be run in a manual operator prompting mode, a fully automated mode, or combinations thereof. In the fully manual mode, the operator must analyze the MS information and physically enter one or more commands and/or settings to begin the next process step. In the fully automated mode, however, the software automatically analyzes the MS information obtained from fs-LID, such as by comparing it to target desired values or ranges, and then determines if a desired result has been obtained. If not, the software automatically isolates the precursor ions of interest of those previously ionized or in a new ion-trap fill from the same source specimen by causing frequency synthesizer 65 (see FIGS. 1 and 19) to expel the undesired ions and retain the desired precursor ions through computer controlled energization of the power supply 63. The software again automatically analyzes and determines if the desired mass spectrum results are obtained. If not, the software automatically isolates the product ions of interest, optionally decides which supplemental fragmentation process to run (e.g., CID, fs-LID again, SID, IRMPD, UVPD, ECD ETD, PSD, EID, EED, EDD, or MAD). An optional set of instructions allow for manually or automatically controlled modification of a laser pulse characteristic and/or operation of the shutter. For example, the pulse shape or duration can be varied between pulses or series of pulses.

It is noteworthy that ionizing an ionized specimen by removing at a least one electron can create multiply positively charged, singly negatively charged or multiply negatively charged ions. It is also worth noting that fs-LID fragmentation and modification of a sample can optionally be facilitated and directed by the addition of high atomic number metal counter-ions. Furthermore, when the term "sample," "specimen" or "same specimen" is used, it includes both situations, where a specific precursor ion is transformed into a product ion which is itself further ionized/fragmented, or where the ion-trap is refilled or reloaded with new portions of the same specimen batch between each ionization/fragmentation process, including multiple separated processes thereon.

Figure 16:
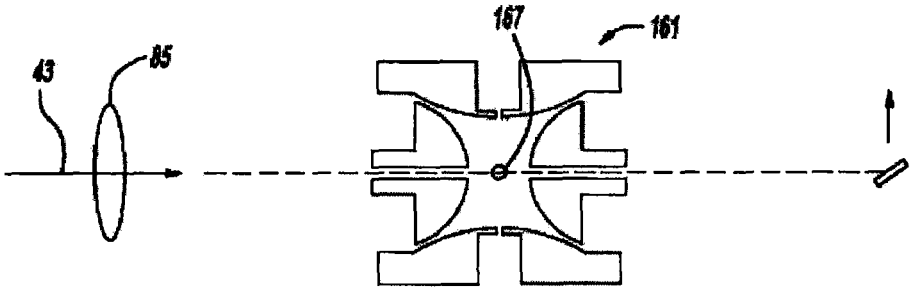
FIG. 16 is a diagrammatic view showing a single pass cavity in a mass spectrometer of the present invention system.
Figure 17:
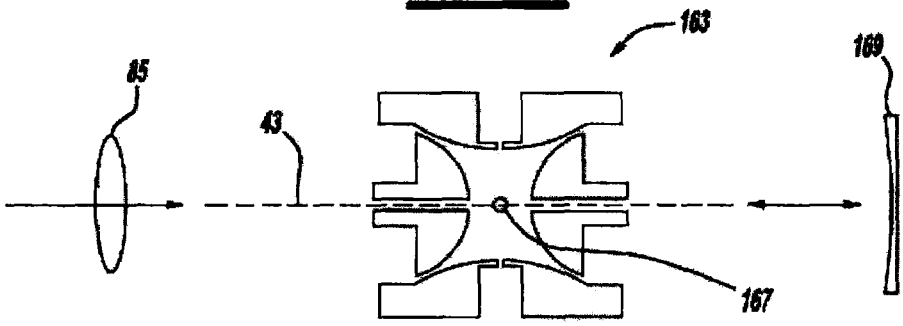
FIG. 17 is a diagrammatic view showing a double pass cavity in a mass spectrometer of the present invention system.
Figure 18:
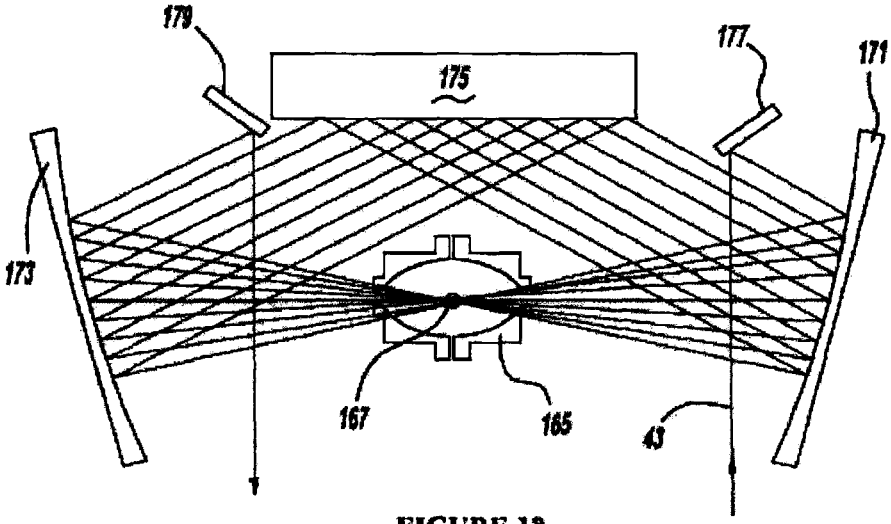
FIG. 18 is a diagrammatic view showing a multipass cavity in a mass spectrometer of the present invention system.

FIGS. 16-18 show various configurations of a three-dimensional ion-trap 161, 163, and 165, respectively, for a mass spectrometer of the present system. A laser pulse 43 is focused in the ion-trap by lens 85 and directed to an ion packet or cloud 167. FIG. 16 illustrates a single pass cavity in the mass spectrometer, where the pulse is transmitted in a single direction from lens 85, to ion packet 167 then to a mirror whereafter it is reflected away from ion-trap 161. FIG. 17 shows a double pass cavity in the mass spectrometer. In this configuration, a concave mirror 169 reflects pulse 43 back into ion-trap 163 to act upon ion packet 167 a second time.

Referring to FIG. 18, a multipass cavity in the mass spectrometer employs a pair of concave mirrors 171 and 173, a flat main mirror 175, and a flat and smaller entry mirror 177, and a flat smaller exist mirror 179. The multipass mirror 171, 173, and 175 generally surround at least three sides of ion packet 167. The multipass cavity construction causes each laser pulse 43 to act up the ion packet multiple times, in this example, at least six times and more preferably, nine times in order to irradiate at least a majority of the ion cloud. This advantageously provides more efficient and quicker ionization and/or fragmentation, which further activates the ionized specimen faster than intramolecular energy redistribution can occur. Furthermore, a single pulse (of a series of pulses) acts multiple times on the ion cloud, where each reflection of the pulse therethrough has the identical pulse characteristics. This is also expected to provide stronger and more easily identifiable mass spectrum information since more abundant data will be generated with greater sensitivity. The multipass cavity configuration is ideally suited for ultrafast and high intensity pulses, such as those of less than 1 ps, with an intensity greater than $10^{12}$ W/cm$^2$ and a wavelength greater than 700 nm, and especially with a 3D or linear ion-trap mass spectrometer.

Another use is for identifying PTM in pharmaceuticals, finding disease markers in molecules, and for metabolic analysis. Further uses include identifying proteins, DNA and RNA for forensics, and to provide a disease prognosis and appropriate corresponding therapies. The present method can alternately be used for disease diagnosis, monitoring disease progression, detecting the presence of a drug, determining stress-related modification and determining predisposition to a disease, through the present fs-LID determination, detection and/or identification of PTMs and metabolites. Another use of the present method is for the study of metabolites. The present method leads to the cleavage of strong bonds that are not usually cleaved by CID. For example, it leads to cross-ring fragmentation in carbohydrates. These types of non-conventional fragmentation patterns are very helpful in metabolomic analysis because they provide additional information that can be used to elucidate the identity and structure of the metabolites. Metabolites can be significant markers for disease, and therefore, monitoring can aid diagnosis and the determination of disease progression. Similarly, pharmaceuticals are metabolized and the resulting metabolites can lead to undesired side effects. Therefore, the present system represents an important new tool for metabolomic analysis for a broad range of small molecules including but not limited to carbohydrates, lipids, steroids, ketones, glycols.

Various embodiments of the present invention have been disclosed but modifications may be made. For example, the present system can optionally be used without MIIPS although many of the advantages may not be realized. Furthermore, a pulse shaper located downstream of the laser amplifier and oscillator may alternately be employed. Additional, fewer or differently placed reflectors, such as mirrors, can be used. Other methods for determining mass to charge such as ion mobility, time-of-flight, reflection, and other types of magnetic or electric lenses and traps, whether they are large or miniature, may be used instead or in addition to those disclosed. Similarly, sample preparation, solvents and their concentrations are typically adjusted to yield a stable ion source. While various optics and equipment types have been disclosed, other devices may alternately be employed as long as the disclosed function is achieved. It is intended by the following Claims to cover these and any other departures from the disclosed embodiments which fall within the true spirit of this invention.

The invention claimed is:

1. A method of using a laser system for mass spectrometry comprising:

(a) emitting at least one shaped laser pulse, having a duration of less than 1 ps and a wavelength greater than 700 nm, at an ionized specimen in a mass spectrometer;

(b) further ionizing the ionized specimen by removing at least one electron in response to step (a);

(c) activating the ionized specimen faster than intramolecular energy redistribution therein in order to control the ionization process in the ionized specimen; and (d) selectively fragmenting specific strong bonds before weak bonds in the specimen; and avoiding a thermalization process during the ionizing.

2. The method of claim 1, wherein each pulse has a peak intensity greater than $10^{12}$ W/cm$^2$ and further comprising avoiding a thermalization process while generating structurally diagnostic fragmentation ions.

3. The method of claim 1, further comprising wherein the shape of the pulse is changed before the pulse emission is directed onto the ionized specimen, and inducing chemical structure-sensitive photodissociation of the ionized specimen in an ion trap of mass spectrometer.

4. The method of claim 1, further comprising automatically characterizing and compensating for phase distortions in the laser pulse, and focusing the pulse having less than a 60 fs duration, into the mass spectrometer.

5. The method of claim 1, further comprising introducing the ionized specimen into the mass spectrometer using electrospray ionization.

6. The method of claim 1, further comprising introducing the ionized specimen into the mass spectrometer using matrix assisted laser desorption ionization.

7. The method of claim 1, further comprising introducing the ionized specimen into the mass spectrometer using desorption electrospray ionization.

8. The method of claim 1, further comprising further ionizing the ionized specimen by further removing at least one electron and obtaining mass spectra information without requiring a chromophore or prior chemical treatment.

9. The method of claim 1, further comprising further ionizing the ionized specimen containing certain modifications, by further removing at least one electron, without losing information about the specific location of the modification.

10. The method of claim 1, wherein step (a) forms a product ion, further comprising isolating the product ion, and thereafter directing another laser pulse of less than 1 ps duration, at the product ion to produce further product ions.

11. The method of claim 1, further comprising using a collision induced dissociation process on the specimen with the same equipment.

12. The method of claim 1, wherein step (a) forms a product ion, further comprising isolating the product ion, and thereafter using a collision induced dissociation process on the product ion to produce further product ions.

13. The method of claim 1, further comprising isolating the ionized specimen in an ion trap of the mass spectrometer, then emitting a series of laser pulses at an already ionized cloud of the ionized specimen to form a product ion by further removing at least one electron and obtaining additional information about the ions of the same mass spectrum receiving multiples of the laser pulse in the ion trap.

14. The method of claim 1, further comprising the following steps in order:

isolating the ionized specimen in the mass spectrometer;

emitting another laser pulse at the ionized specimen to form a product ion by removing at least one electron;

further isolating the product ion; and directing another laser pulse, of less than 1 ps duration, at the product ion to produce further product ions.

15. The method of claim 1, further comprising the following steps in order:

isolating an ionized specimen in the mass spectrometer;

emitting another laser pulse at the ionized specimen to form a product ion by removing at least one electron;

further isolating the product ion; and using a collision induced dissociation process on the product ion to produce further product ions.

16. The method of claim 1, further comprising the following steps in order:

isolating an ionized specimen in the mass spectrometer;

using a collision induced dissociation process to produce product ions;

further isolating a product ion; and emitting another laser pulse at the product ion to produce further product ions.

17. The method of claim 1, further comprising reflecting the shaped pulse within a multipass cavity of the mass spectrometer.

18. The method of claim 1, further comprising retaining ions in a three-dimensional ion-trap of the mass spectrometer.

19. The method of claim 1, further comprising retaining ions in a linear ion-trap of the mass spectrometer.

20. A method of using a laser system for mass spectrometry comprising:

(a) emitting at least one shaped laser pulse, having a duration of less than 1 ps and a wavelength greater than 700 nm, at an ionized specimen in a mass spectrometer;

(b) fragmenting strong bonds before weak bonds of the ionized specimen in response to step (a); and (c) activating the ionized specimen faster than intramolecular energy redistribution therein in order to control the fragmentation process in the ionized specimen; and avoiding a thermalization process during the ionizing.

21. The method of claim 20, wherein the pulse has a peak intensity greater than $10^{12}$ W/cm$^2$ and further comprising avoiding a thermalization process while generating structurally diagnostic fragmentation ions.

22. The method of claim 20, further comprising selectively fragmenting specific strong bonds before weak bonds in the specimen.

23. The method of claim 20, further comprising automatically characterizing and compensating for phase distortions in the pulse, and focusing the pulse, having less than a 60 fs duration, into the mass spectrometer.

24. The method of claim 20, wherein the fragmenting step further comprises fragmenting the ionized specimen containing certain modifications without losing information about the specific location of the modification.

25. The method of claim 20, further comprising using a collision induced dissociation process on the specimen with the same equipment either before or after the fragmenting step.

26. The method of claim 20, further comprising isolating the ionized specimen in the mass spectrometer, then emitting another laser pulse at the ionized specimen to fragment the ionized specimen to form product ions.

27. The method of claim 20, further comprising reflecting the shaped pulse within a multipass cavity of the mass spectrometer.

28. A method of using a laser system for mass spectrometry comprising:

(a) emitting a series of laser pulses, each having a duration of less than 1 ps and a wavelength greater than 700 nm, at a precursor ion;

(b) using the pulses to remove at least one electron from the precursor ion, and to cause at least one of: (i) fragmentation of precursor ion, and (ii) removal of at least one electron from the precursor ion, to create a product ion; and (c) isolating precursor ions of interest in an ion trap of a mass spectrometer from these previously ionized; and (d) inducing chemical structure-sensitive photodissociation of the specimen while avoiding a thermalization process on the ionized specimen.

29. The method of claim 28, further comprising using a collision induced dissociation process on the product ion with the same equipment and software instructions, stored in computer memory, automatically performing step (c).

30. The method of claim 28, further comprising:

using electrospray on the precursor ion;

retaining the ions in an ion-trap of the mass spectrometer;

automatically characterizing and compensating for phase distortions in the pulse; and focusing the series of laser pulses, each having less than a 60 fs duration, into the ion trap.

31. The method of claim 28, further comprising:

isolating the desired productions after step (b);

thereafter further ionizing and fragmenting the product ions with another series of shaped laser pulses, each having a duration less than 1 ps; and obtaining mass spectra information without a chromophore or chemical treatment.

32. The method of claim 28, further comprising introducing the precursor ions into a mass spectrometer using electrospray.

33. The method of claim 28, further comprising achieving ionization and fragmentation of the precursor ions containing certain modifications without losing information about the specific location of the modification.

34. A method of using a laser system for mass spectrometry comprising:

(a) emitting a series of laser pulses, each having a duration of less than 1 ps and a wavelength greater than 700 nm, at a precursor ion;

(b) using the pulses to remove at least one electron from the precursor ion, and to cause at least one of: (i) fragmentation of precursor ion, and (ii) removal of at least one electron from the precursor ion, to create a product ion; and (c) reflecting the shaped pulses within a multipass cavity of a mass spectrometer.

35. The method of claim 28, further comprising automatically characterizing and compensating for phase distortions in the series of laser pulses, and focusing the pulses, each having less than a 60 fs duration, into an ion trap.

36. The method of claim 28, further comprising using software instructions to automatically determine if desired information has been obtained from the fs-laser induced ionization/dissociation.

37. A method of using a laser system for mass spectrometry comprising:

(a) emitting at least one laser pulse at an ionized specimen in a mass spectrometer;

(b) using software instructions to determine if desired mass spectra information has been obtained in response to step (a), and if not, using software instructions to automatically:

(i) isolate a product ion formed from the ionized specimen; and (ii) emit another laser pulse at the already ionized specimen in an ion trap of the mass spectrometer to obtain additional mass spectrum information; and wherein the laser pulse has a duration of less than 60 fs, a wavelength greater than 700 nm and peak intensity greater than $10^{12}$ W/cm$^2$; and wherein a thermalization process is avoided during the ionizing.

38. The method of claim 37, further comprising automatically (a) and (b) without requiring manual operator intervention.

39. The method of claim 37, further comprising using software instructions to automatically conduct a collision induced dissociation process on the specimen within the same equipment.

40. The method of claim 37, further comprising changing a shape of a subsequent pulse before the pulse emission is repeated onto the product ions.

41. The method of claim 37, further comprising obtaining mass spectra information without a chromophore or chemical treatment of the specimen.

42. The method of claim 37, wherein the laser pulse has a duration of less than 60 fs, a wavelength greater than 700 nm and peak intensity greater than $10^{12}$ W/cm$^2$.

43. The method of claim 37, further comprising automatically characterizing and compensating for phase distortions in the laser pulse, and focusing the pulse into an ion trap of the mass spectrometer.

44. A method of using a laser system for mass spectrometry comprising:

(a) using electrospray to introduce an ionized specimen into a mass spectrometer, ionizing the ionized specimen and obtaining mass spectra information without a chromophore or chemical treatment;

(b) emitting a laser pulse, having a duration of less than 1 ps, a wavelength greater than 700 nm, and a peak intensity greater than $10^{12}$ W/cm$^2$, at the ionized specimen in a mass spectrometer;

(c) using fs-laser induced ionization or dissociation to remove at least one electron from the ionized specimen;

(d) retaining the ions in an ion-trap of the mass spectrometer;

(e) analyzing post-translational modifications; and (f) inducing chemical structure-sensitive photodissociation of the specimen while avoiding a thermalization process on the ionized specimen.

45. The method of claim 44, wherein the specimen is at least one of:

a protein, peptide, metabolite, PTM protein, and PTM peptide.

46. The method of claim 44, further comprising using a collision induced dissociation process on the same ionized specimen with the same equipment.

47. The method of claim 44, further comprising:

isolating a product ion; and emitting another laser pulse at the production to further remove at least another electron from the product ion.

48. The method of claim 44, further comprising achieving photodissociation of modified peptides without losing information about the specific location of the modification.

49. The method of claim 44, further comprising the following steps in order:

isolating an ionized specimen in the mass spectrometer;

emitting another laser pulse at the ionized specimen to form a product ion by removing at least one electron;

further isolating the product ion; and using a collision induced dissociation process on the product ion to produce further product ions.

50. The method of claim 44, further comprising diagnosing a disease based, at least in part, on the analyzing step.

51. The method of claim 44, further comprising monitoring progression of a disease based, at least in part, on the analyzing step.

52. The method of claim 44, further comprising detecting the presence of a drug based, at least in part, on the analyzing step.

53. The method of claim 44, further comprising determining predisposition to a disease based, at least in part, on the analyzing step.

54. The method of claim 44, further comprising determining stress-related modifications based, at least in part, on the analyzing step.

55. A method of using a laser system for mass spectrometry comprising:

(a) emitting at least one laser pulse at a precursor ion in a mass spectrometer in order to further ionize or fragment the precursor ion;

(b) performing a second process on a product ion created by step (a) using at least one of: (i) CID; (ii) SID; (iii) IRMPD; (iv) UVPD; (v) ECD; (vi) ETD; (vii) PSD; (viii) EID; (ix) EED; (x) EDD; and (xi) MAD, wherein the performing of the second process is in an ion-trap of the same mass spectrometer; and (c) breaking strong bonds before weak bonds in the ion-trap; and further comprising using a laser pulse having a duration of less than 1 ps and a wavelength greater than 700 nm; and wherein a thermalization process is avoided during the ionizing.

56. The method of claim 55, further comprising using a laser pulse having a duration of less than 1 ps.

57. The method of claim 55, further comprising using a laser pulse having a wavelength greater than 700 nm.

58. The method of claim 55, wherein the second process is CID.

59. The method of claim 55, further comprising automatically performing the second process based on detected mass-to-charge information from the precursor ion after the emission of the pulse thereat.

60. The method of claim 55, further comprising performing at least a third ionization or fragmentation process on the product ion created by the second process.

61. The method of claim 55, further comprising removing at least one electron from at least one of the ions.

62. The method of claim 34, further comprising using a collision induced dissociation process on the product ion with the mass spectrometer.

63. The method of claim 34, further comprising:

using electrospray on the precursor ion;

retaining the ions in an ion-trap of the mass spectrometer;

automatically characterizing and compensating for phase distortions in the pulse; and focusing the series of laser pulses, each having less than a 60 fs duration, into the ion trap.

64. The method of claim 34, further comprising:

isolating the desired productions after step (b);

thereafter further ionizing and fragmenting the product ions with another series of shaped laser pulses, each having a duration less than 1 ps; and obtaining mass spectra information without a chromophore or chemical treatment.

65. The method of claim 34, further comprising introducing the precursor ions into the mass spectrometer using electrospray.

66. The method of claim 34, further comprising achieving ionization and fragmentation of the precursor ions containing certain modifications without losing information about the specific location of the modification.

67. The method of claim 34, further comprising automatically characterizing and compensating for phase distortions in the series of laser pulses, and focusing the pulses, each having less than a 60 fs duration, into an ion trap of the mass spectrometer.

68. The method of claim 34, further comprising using software instructions to automatically determine if desired information has been obtained from the fs-laser induced ionization/dissociation.

69. The method of claim 34, further comprising isolating the precursor ions of interest from those previously ionized to gain additional information about the mass spectrum of the ions of interest.

* * * * *